US012065811B2

(12) United States Patent
Ghiglieri et al.

(10) Patent No.: US 12,065,811 B2
(45) Date of Patent: Aug. 20, 2024

(54) SYSTEMS AND METHODS FOR COUPLING OF A TUB SPOUT

(71) Applicant: Danco, Inc., Irving, TX (US)

(72) Inventors: Bill Ghiglieri, Reno, NV (US); Muhammad Hossain, Dallas, TX (US); Robert Clifton Jones, Jr., Rockwall, TX (US); Casey J. Fregoe, The Colony, TX (US)

(73) Assignee: Danco, Inc., Irving, TX (US)

( * ) Notice: Subject to any disclaimer, the term of this patent is extended or adjusted under 35 U.S.C. 154(b) by 751 days.

(21) Appl. No.: 16/548,447

(22) Filed: Aug. 22, 2019

(65) Prior Publication Data

US 2020/0063406 A1 Feb. 27, 2020

Related U.S. Application Data

(60) Provisional application No. 62/840,597, filed on Apr. 30, 2019, provisional application No. 62/721,627, filed on Aug. 23, 2018.

(51) Int. Cl.
*E03C 1/04* (2006.01)

(52) U.S. Cl.
CPC ..... *E03C 1/0402* (2013.01)

(58) Field of Classification Search
CPC ..... E03C 1/042; E03C 1/0402; E03C 1/0403; E03C 1/0401; E03C 1/0404
See application file for complete search history.

(56) References Cited

U.S. PATENT DOCUMENTS 2,250,517 A * 7/1941 Zolleis ..... F16L 27/1274 285/348
3,136,570 A * 6/1964 Lee ..... E03C 1/042 285/193
6,192,529 B1 * 2/2001 Jones ..... E03C 1/042 285/46
6,301,727 B1 * 10/2001 Bertrand ..... E03C 1/042 285/8
6,334,463 B1 * 1/2002 Lee ..... E03C 1/042 285/193
7,472,434 B1 * 1/2009 Moldthan ..... E03C 1/0401 4/678
8,763,624 B1 * 7/2014 Huang ..... F16K 11/04 251/339
9,790,667 B2 * 10/2017 Du ..... F16K 3/0254
2004/0261853 A1 * 12/2004 Jennings ..... E03C 1/042 137/360
2007/0232108 A1 * 10/2007 Miura ..... E03C 1/0403 439/310
2012/0266989 A1 * 10/2012 Huang ..... E03C 1/042 137/798
2018/0238476 A1 * 8/2018 Swadesh ..... F16L 15/02
2020/0048880 A1 * 2/2020 Varma ..... E03C 1/0404

FOREIGN PATENT DOCUMENTS

CA 2576666 * 4/2010 ..... E03C 1/0403

* cited by examiner

*Primary Examiner* — J C Jacyna
(74) *Attorney, Agent, or Firm* — Thomas | Horstemeyer, LLP

(57) ABSTRACT

Disclosed are various embodiments providing a mechanism to couple a tub spout onto a pipe. An extension nipple adaptor can be coupled to the pipe. A compression ring can be positioned between the extension nipple adaptor and an extension nipple. The tub spout can couple to the extension nipple. A threaded screw can be screwed into the extension nipple adaptor and contact the pipe.

16 Claims, 24 Drawing Sheets

SYSTEMS AND METHODS FOR COUPLING OF A TUB SPOUT

CROSS REFERENCE TO RELATED APPLICATIONS

This application claims the benefit of, and priority to, U.S. Provisional Patent Application No. 62/721,627, entitled "SYSTEMS AND METHODS FOR COUPLING OF A TUB SPOUT," filed on Aug. 23, 2018 and U.S. Provisional Patent Application No. 62/840,597, entitled "SYSTEMS AND METHODS FOR COUPLING OF A TUB SPOUT," filed on Apr. 30, 2019, which are both hereby incorporated herein by reference in their entireties.

BACKGROUND

A bathtub is a common feature installed in residential bathrooms. As part of the installation, a bathtub spout can be attached to a pipe from the wall. Oftentimes, the bathtub spout attachment process is a timing consuming process and requires the use of several additional components.

BRIEF DESCRIPTION OF THE DRAWINGS

For a more complete understanding of the embodiments and the advantages thereof, reference is now made to the following description, in conjunction with the accompanying figures briefly described as follows.

Figure 1:
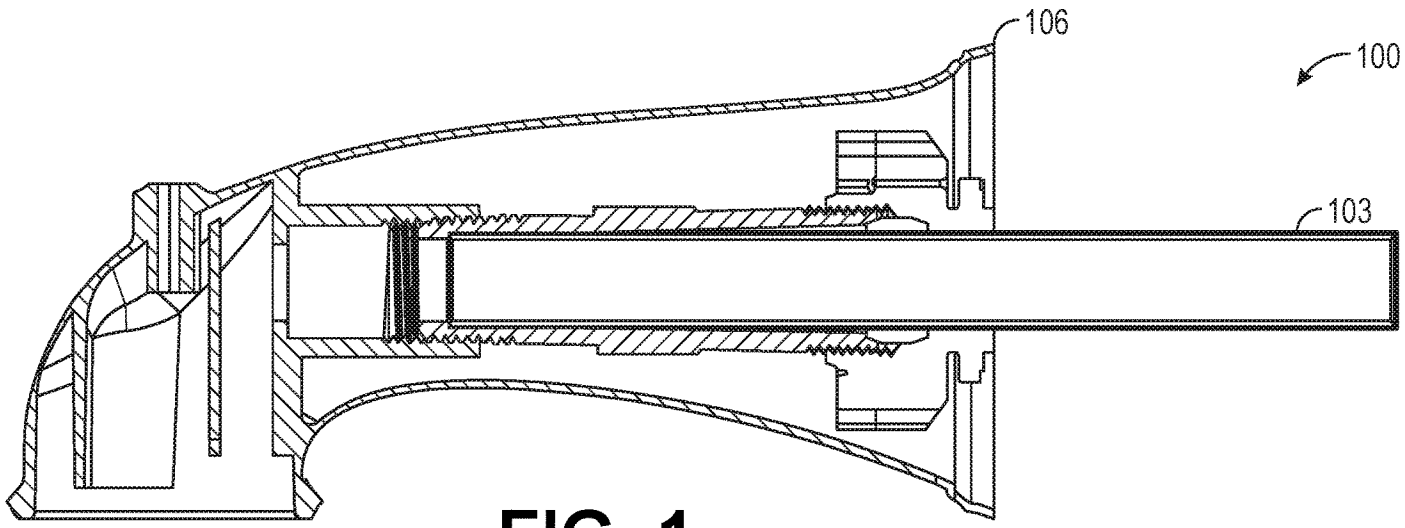
FIG. 1 illustrates a side cross-sectional view of a tub spout according to various embodiments of the present disclosure.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

In the following paragraphs, the embodiments are described in further detail by way of example with reference to the attached drawings. In the description, well known components, methods, and/or processing techniques are omitted or briefly described so as not to obscure the embodiments. As used herein, the "present disclosure" refers to any one of the embodiments described herein and any equivalents. Furthermore, reference to various feature(s) of the "present embodiment" is not to suggest that all embodiments must include the referenced feature(s).

Figure 2:
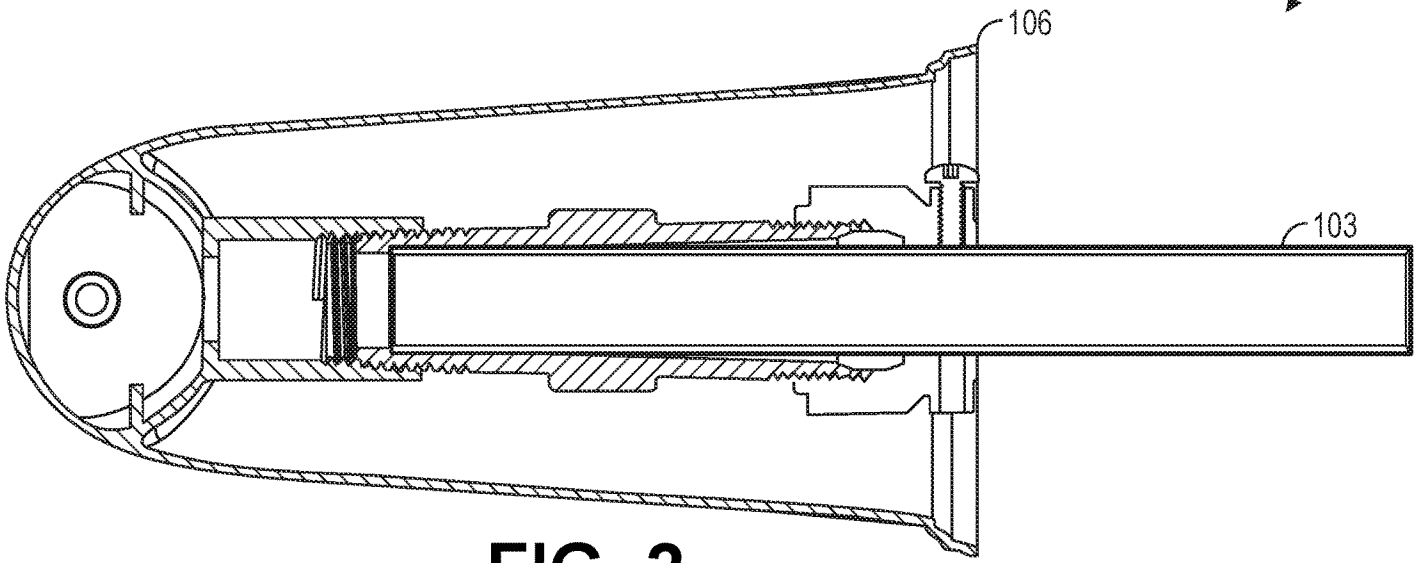
FIG. 2 illustrates a bottom cross-sectional view of a tub spout according to various embodiments of the present disclosure.

With reference to FIGS. 1 and 2, shown are a side cross-sectional view and a bottom cross-sectional view of a spout 100 according to various embodiments of the present disclosure. The spout 100 can include a tub spout 106 affixed to a pipe 103. The tub spout 106 can be affixed to the pipe 103 using one or more spout coupling mechanisms discussed herein.

Figure 3A:
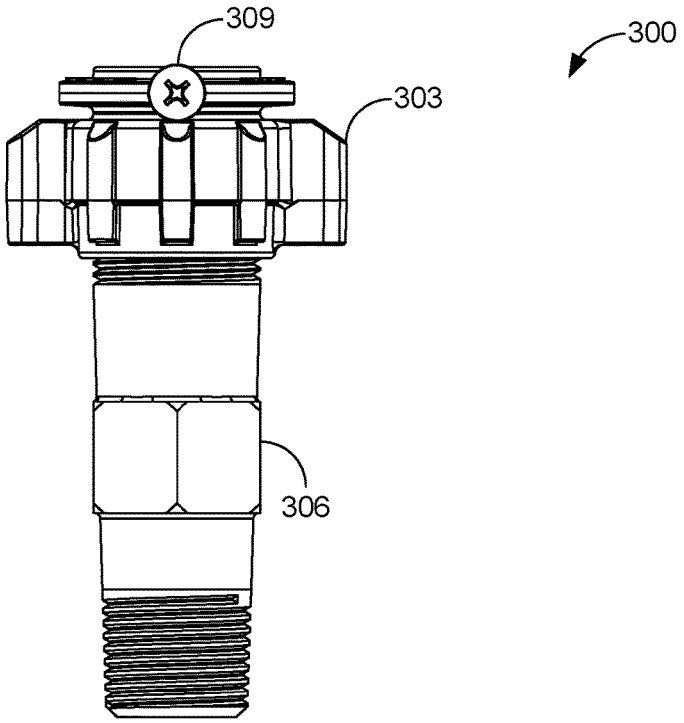
FIG. 3A illustrates a spout coupling mechanism according to various embodiments of the present disclosure.

With reference to FIG. 3A, shown is a spout coupling mechanism 300 according to various embodiments of the present disclosure. The mechanism 300 includes a compression nut 303, an extension nipple 306, and a threaded forming screw 309. The extension nipple 306 can be coupled to a tub spout 106 (FIG. 1). The compression nut 303 can be screwed onto the extension nipple 306. The threaded forming screw 309 can be screwed into the compression nut 303. When screwed in, a threaded end of the threaded forming screw 309 can protrude from an inner surface of the compression nut 303. The threaded end can contact a pipe 103 (FIG. 1), which can prevent the pipe 103 from being removed from the compression nut 303. The pipe 103 can be a copper supply line for a bathtub.

As an example, the pipe 103 can be inserted into the mechanism 300. The pipe 103 can pass through an opening in the compression nut 303 and into an opening of the extension nipple 306. Once inserted, the screw 309 can be screwed in to contact the pipe 103. The contact of the screw 309 to the pipe 103 can prevent the pipe 103 from being pulled from the mechanism 300. The extension nipple 306 can include two or more threaded portions. The threaded portions can be separated by a hex portion. A wrench can be used to turn the extension nipple 306 using the hex portion.

The extension nipple 306 can be coupled to a tub spout by screwing the tub spout onto the first threaded portion of the extension nipple 306. The tub spout can include a threaded hole in which the first threaded portion is screwed into. The compression nut 303 can be coupled to the extension nipple 306 by screwing the compression nut 303 onto the second threaded portion of the extension nipple 306.

Figure 3B:
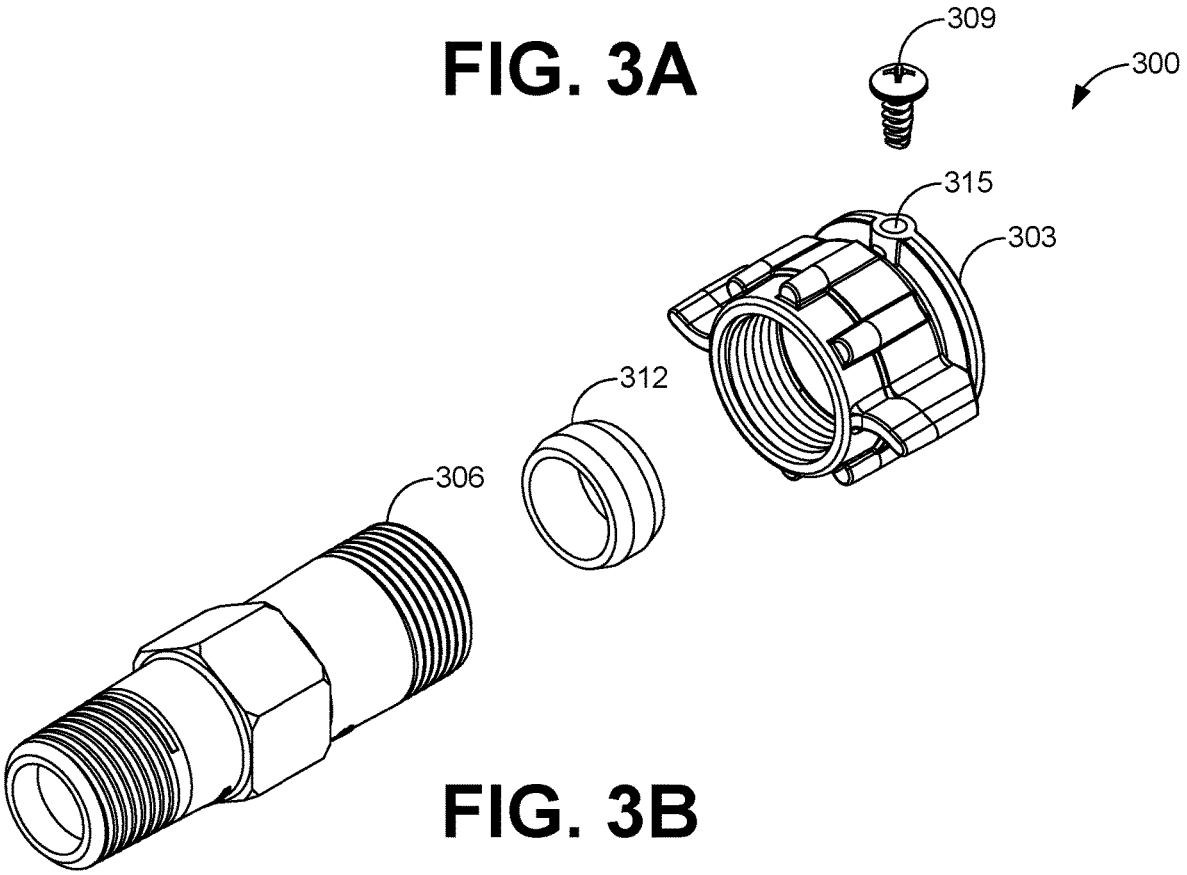
FIG. 3B illustrates an exploded view of a spout coupling mechanism according to various embodiments of the present disclosure.

With reference to FIG. 3B, shown is an exploded view of the spout coupling mechanism 300 according to various embodiments of the present disclosure. The mechanism 300 includes a compression ring 312. The compression ring 312 can be positioned between the extension nipple 306 and the compression nut 303. The compression ring 312 can slide over a pipe 103. When the compression nut 303 is screwed on to the extension nipple 306, the compression ring 312 can be compressed against the pipe 103 between the compression nut 303 and the extension nipple 306.

The compression of the compression ring 312 can hold the pipe 103 in place within the mechanism 300. The compression ring 312 can be compressed between the compression nut 303 and the extension nipple 306 based on screwing the compression nut 303 onto the second threaded portion of the extension nipple 306. The extension nipple 306 can be made from an acetal copolymer or other material. The compression nut 303 can include an aperture 315 in which the screw 309 can be screwed into. The aperture 315 can include threads to facilitate telescoping of the screw 309 in and out of the aperture 315 by turning the screw 309.

Figure 4A:
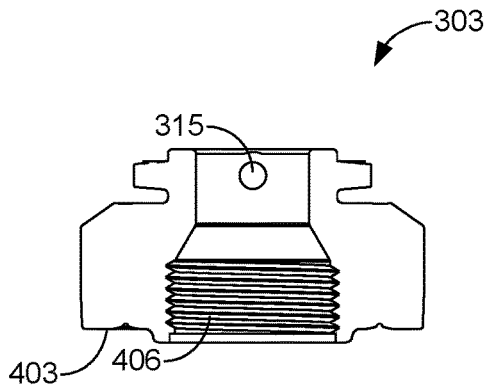
FIG. 4A illustrates a side cross-sectional view of a compression nut according to various embodiments of the present disclosure.

With reference to FIG. 4A, shown is a side cross-sectional view of the compression nut 303 according to various embodiments of the present disclosure. The compression nut 303 can include an aperture 315, one or more tabs 403, and threads in an aperture 406 of the compression nut 303. The tabs 403 on the compression nut 303 can facilitate hand-tightening the compression nut 303 onto the extension nipple 306. In some embodiments, the compression nut 303 can be made from a 30% glass filled polypropylene copolymer or other materials.

Figure 4B:
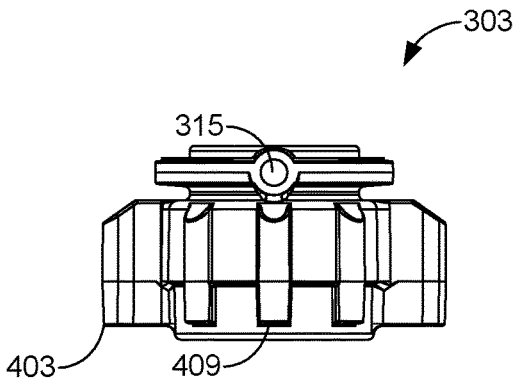
FIG. 4B illustrates a side view of a compression nut according to various embodiments of the present disclosure.

With reference to FIG. 4B, shown is a side view of the compression nut 303 according to various embodiments of the present disclosure. The compression nut 303 can include one or more tabs 403 of a first size and one or more tabs 409 of a second size.

Figure 4C:
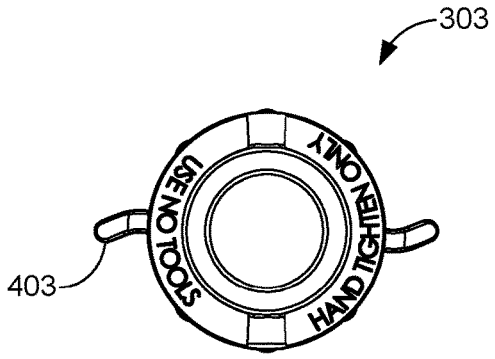
FIG. 4C illustrates a bottom view of a compression nut according to various embodiments of the present disclosure.

With reference to FIG. 4C, shown is a bottom view of the compression nut 303 according to various embodiments of the present disclosure. The compression nut 303 can include instructions indicating to hand-tighten the compression nut 303. If the compression nut 303 is turned with torque exceeding that of a hand tightening force when tightening the compression nut 303, the threads can strip.

Figure 4D:
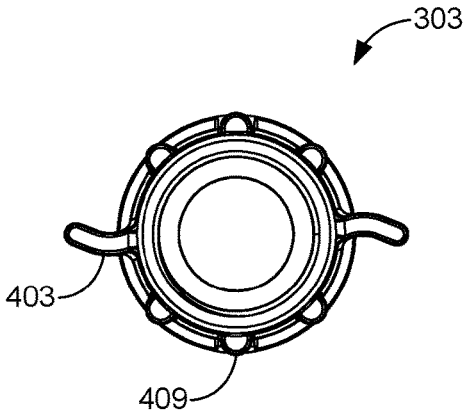
FIG. 4D illustrates a top view of a compression nut according to various embodiments of the present disclosure.

With reference to FIG. 4D, shown is a top view of the compression nut 303 according to various embodiments of the present disclosure. The tabs 403 can have a curvature in to provide a rounded edge in the direction of tightening the compression nut 303 onto the extension nipple 306. In some embodiments, there are six tabs 409 and two tabs 403 spaced evenly around a perimeter of the compression nut 303. The tabs 403 can be positioned opposite one another.

Figure 5A:
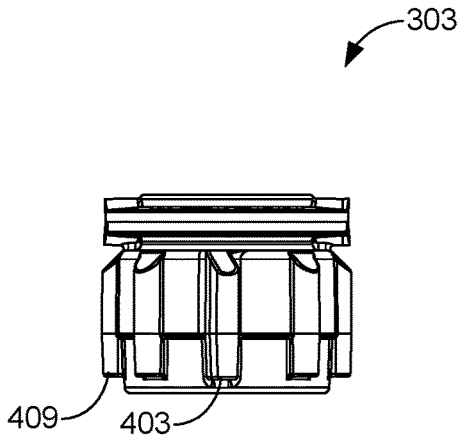
FIG. 5A illustrates another side view of a compression nut according to various embodiments of the present disclosure.

With reference to FIG. 5A, shown is another side view of the compression nut 303 according to various embodiments of the present disclosure. The compression nut 303 shown in FIG. 5A corresponds to the view of FIG. 4B rotated 90 degrees.

Figure 5B:
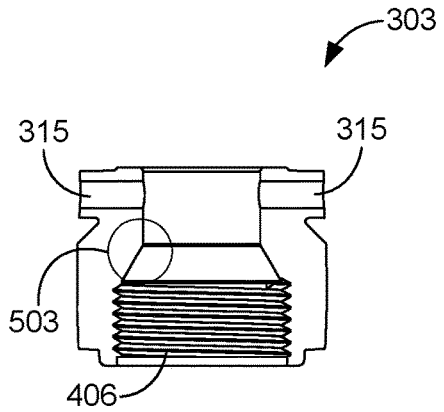
FIG. 5B illustrates another side cross-sectional view of a compression nut according to various embodiments of the present disclosure.

With reference to FIG. 5B, shown is another side cross-sectional view of the compression nut 303 according to various embodiments of the present disclosure. The aperture 406 can be tapered inward toward one side. The aperture 406 can have a portion with a first diameter, a portion 503 with a tapered diameter, and a portion with a second diameter. The aperture 406 can include 15⁄16" 16 UN threads, 13⁄16" 18 UN threads, or some other type of thread. The compression nut 303 can include two apertures 315 in which two screws 309 can be screwed into. The two screws 309 can contact the pipe 103 from opposite sides to secure the pipe 103.

Figure 6:
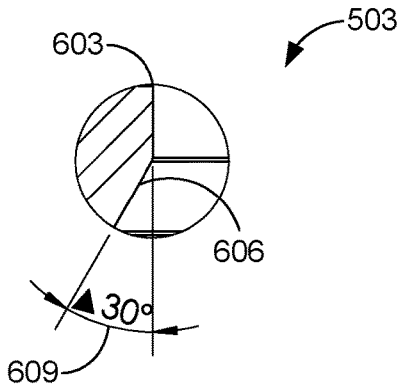
FIG. 6 illustrates a portion of the compression nut according to various embodiments of the present disclosure.

With reference to FIG. 6, shown is a portion 503 of the compression nut 303 according to various embodiments of the present disclosure. The portion can include a first angular surface 603 corresponding to a portion of reduced diameter portion of the compression nut 303 and a second angular surface 606 corresponding to a tapered portion 503 of the compression nut 303. In some embodiments, an angle between the first angular surface 603 and the second angular surface 606 can be 30 degrees.

Figure 7A:
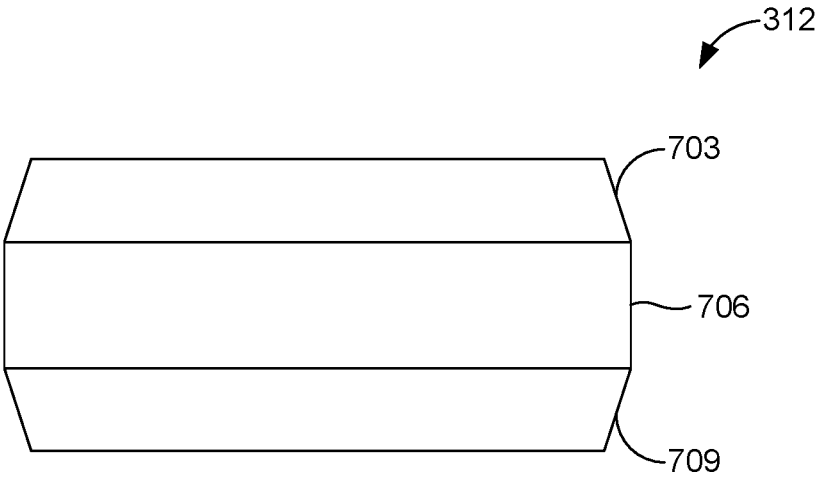
FIG. 7A illustrates a side view of a compression ring according to various embodiments of the present disclosure.

With reference to FIG. 7A, shown is a side view of the compression ring 312 according to various embodiments of the present disclosure. The compression ring 312 can include a first tapered portion 703, a second portion 706, and a third tapered portion 709. In one embodiment, a height of the compression ring 312 can be 0.385 inches. The compression ring can be made from a chloramine resistant material. In some embodiments, the compression ring can have a hardness of between 75 and 85 Shore A. In another embodiment, the hardness can be 80 Shore A.

Figure 7B:
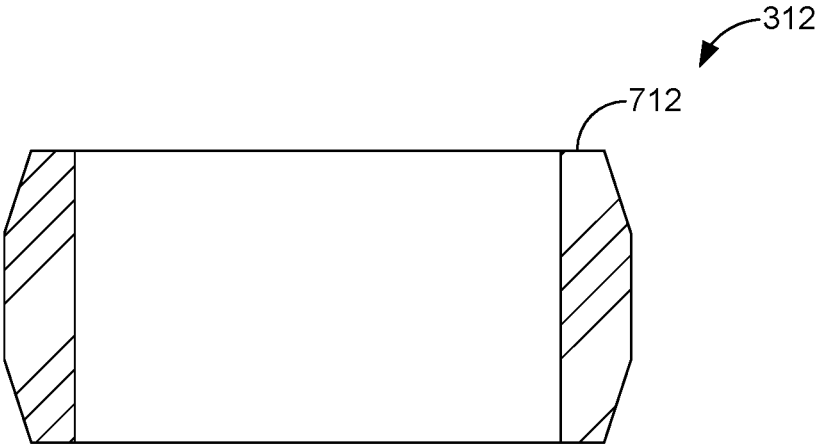
FIG. 7B illustrates a side cross-sectional view of a compression ring according to various embodiments of the present disclosure.

With reference to FIG. 7B, shown is a side cross-sectional view of the compression ring 312 according to various embodiments of the present disclosure. The compression ring 312 can include an annular wall 712. The annular wall 712 can have a fixed inner diameter. An inner surface of the annular wall 712 can contact the pipe 103 (FIG. 1) when the compression ring 312 is slid over the pipe 103. Compression can be applied to an outside surface of the annular wall 712 from the compression nut 303 and the extension nipple 306 being screwed together. The compression can cause the inner surface of the annular wall to compress against the pipe 103.

Figure 8A:
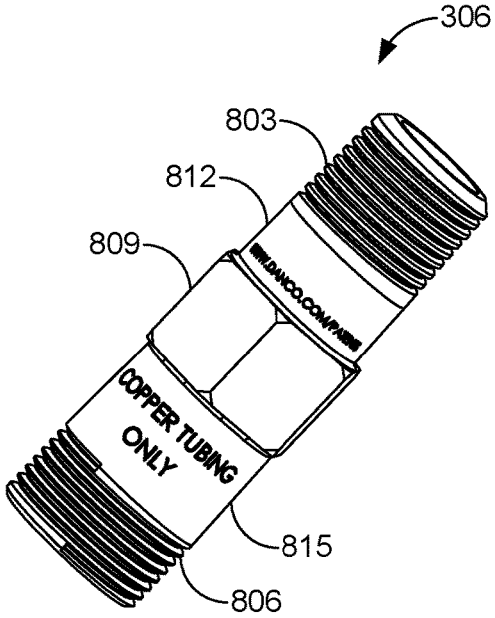
FIG. 8A illustrates a perspective view of an extension nipple according to various embodiments of the present disclosure.

With reference to FIG. 8A, shown is a perspective view of the extension nipple 306 according to various embodiments of the present disclosure. The extension nipple 306 can include a two or more threaded portions 803 and 806. The threaded portions 803 and 806 can be separated by a hex portion 809. An annular portion 812 can separate the threaded portion 803 and the hex portion 809. An annular portion 815 can separate the threaded portion 806 and the hex portion 809. A length of the threaded portions 803 and 806 can be determined to provide a stop. As an example, when the compression nut 303 is screwed onto the extension nipple 306, the compression nut 303 can reach the end of the threads in threaded portion 806 when the compression nut 303 is screwed on all the way. The end of the threads can prevent the compression nut 303 from being turned beyond a threshold point.

A wrench can be used to turn the extension nipple 306 using the hex portion 809. In some embodiments, the hex portion may have another shape, such as, for example, a rectangular shape or other shape. The extension nipple 306 can be made from an acetal copolymer or another material. The extension nipple 306 can be coupled to a tub spout by screwing the tub spout onto the threaded portion 803 of the extension nipple 306. The tub spout can include a threaded hole in which the threaded portion 803 is screwed into. The compression nut 303 can be coupled to the extension nipple 306 by screwing the compression nut 303 onto the threaded portion 806 of the extension nipple 306.

Figure 8B:
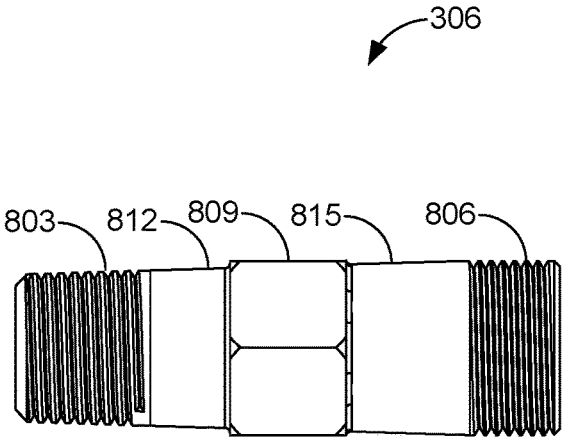
FIG. 8B illustrates a side view of an extension nipple according to various embodiments of the present disclosure.

With reference to FIG. 8B, shown is a side view of the extension nipple 306 according to various embodiments of the present disclosure. The extension nipple 306 can gradually reduce in diameter from a greatest diameter at an end of threaded portion 806 to a least diameter at an opposite end of threaded portion 803. The internal diameter and external diameter can both gradually reduce. The threaded portion 803 can be longer than the threaded portion 806.

Figure 8C:
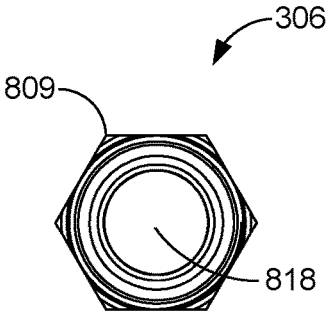
FIG. 8C illustrates a top view of an extension nipple according to various embodiments of the present disclosure.
Figure 8D:
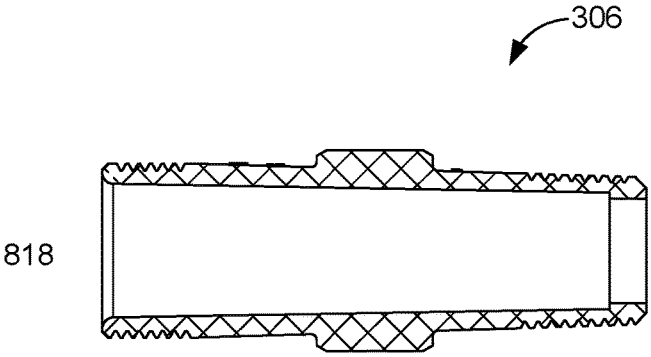
FIG. 8D illustrates a side cross-sectional view of an extension nipple according to various embodiments of the present disclosure

With reference to FIG. 8C, shown is a top view of the extension nipple 306 according to various embodiments of the present disclosure. The hex portion 809 can be visible from the top view. An aperture 818 can pass through the middle of the extension nipple 306. The aperture 818 can reduce in size from one end to another end.

Figure 9A:
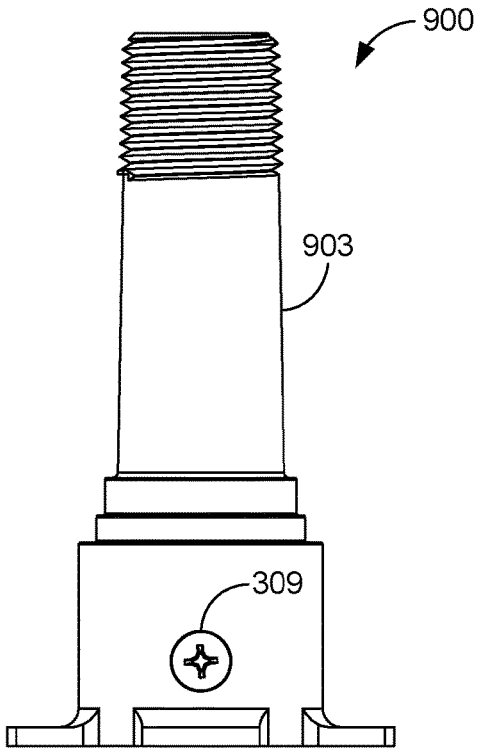
FIG. 9A illustrates a tub spout coupling mechanism according to various embodiments of the present disclosure.

With reference to FIG. 9A, shown is a spout coupling mechanism 900 according to various embodiments of the present disclosure. The mechanism 900 can include an extension nipple 903 and a screw 309. The extension nipple 903 can be coupled to a tub spout 106 (FIG. 1). The threaded forming screw 309 can be screwed into the extension nipple 903. When screwed in, a threaded end of the threaded forming screw 309 can protrude from an inner surface of the extension nipple 903. The threaded end can contact a pipe 103 (FIG. 1), which can prevent the pipe 103 from being removed from the extension nipple 903. The pipe 103 can be a copper supply line for a bathtub.

As an example, the pipe 103 can be inserted into the mechanism 900. The pipe 103 can pass through an opening in the extension nipple 903. Once inserted, the screw 309 can be screwed in to contact the pipe 103. The contact of the screw 309 to the pipe 103 can prevent the pipe 103 from being pulled from the mechanism 900. The extension nipple 903 can include a threaded portion at a first end and an opening on a second end opposite the first end. The extension nipple 903 can be coupled to a tub spout by screwing the tub spout onto the threaded portion of the extension nipple 903. The tub spout can include a threaded hole in which the threaded portion is screwed into.

Figure 9B:
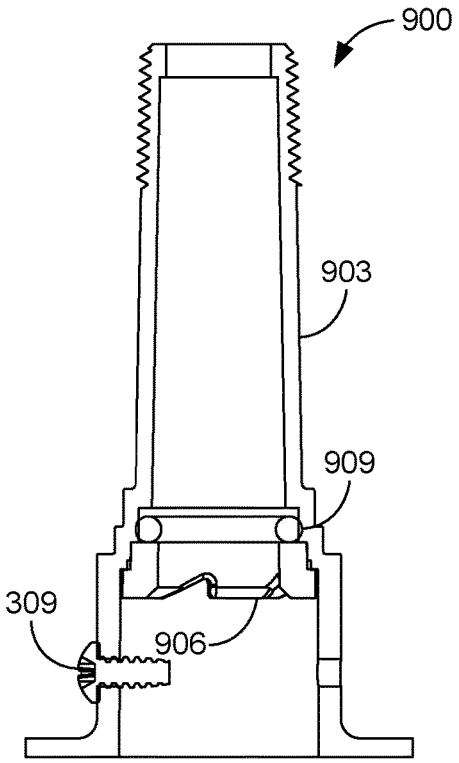
FIG. 9B illustrates a cross-sectional view of a tub spout coupling mechanism according to various embodiments of the present disclosure.

With reference to FIG. 9B, shown is a cross-sectional view of the spout coupling mechanism 900 according to various embodiments of the present disclosure. The mechanism 900 can include an extension nipple 903, a spin weld retaining ring 906, an O-ring 909, and a screw 309. The O-ring 909 can be positioned between the extension nipple 903 and the spin weld retaining ring 906. The O-ring 909 can provide a seal between the pipe 103 and the mechanism 900. The O-ring can form a seal between the extension nipple (903) and the spin weld retaining ring (906). The spin weld retaining ring 906 can contact an internal portion of the extension nipple 903.

Figure 9C:
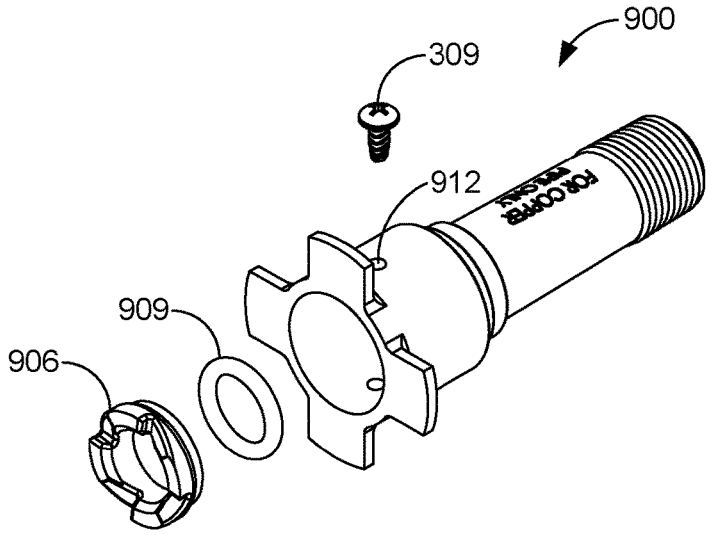
FIG. 9C illustrates an exploded perspective view of a tub spout coupling mechanism according to various embodiments of the present disclosure.

With reference to FIG. 9C, shown is an exploded perspective view of the tub spout coupling mechanism 900 according to various embodiments of the present disclosure. The extension nipple 903 comprises an aperture 912 that the screw 309 screws into. The O-ring 909 can be inserted into an opening of the extension nipple 903. Next, the spin weld retaining ring 906 can be inserted into the opening of the extension nipple 903. The spin weld retaining ring 906 can weld against an inner surface of the extension nipple 903 to hold the spin weld retaining ring 906 in place. The spin weld retaining ring 906 can hold the O-ring 909 in place relative to the extension nipple 903.

Figure 10A:
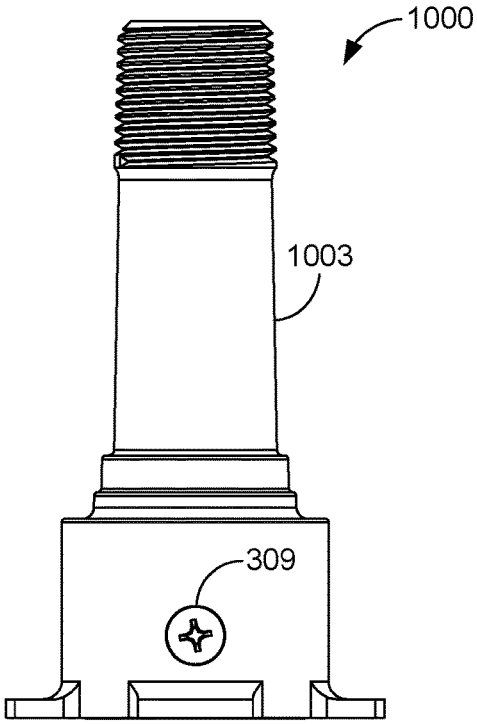
FIG. 10A illustrates a tub spout coupling mechanism according to various embodiments of the present disclosure.

With reference to FIG. 10A, shown is a spout coupling mechanism 1000 according to various embodiments of the present disclosure. The mechanism 1000 can include an adaptor nipple 1003 and a screw 309. The adaptor nipple 1003 can be coupled to a tub spout 106 (FIG. 1). The thread forming screw 309 can be screwed into the adaptor nipple 1003. When screwed in, a threaded end of the threaded forming screw 309 can protrude from an inner surface of the adaptor nipple 1003. The threaded end can contact a pipe 103 (FIG. 1), which can prevent the pipe 103 from being removed from the adaptor nipple 1003. The pipe 103 can be a copper supply line for a bathtub.

As an example, the pipe 103 can be inserted into the mechanism 1000. The pipe 103 can pass through an opening in the adaptor nipple 1003. Once inserted, the screw 309 can be screwed in to contact the pipe 103. The contact of the screw 309 to the pipe 103 can prevent the pipe 103 from being pulled from the mechanism 1000. The adaptor nipple 1003 can include a threaded portion at a first end and a threaded opening on a second end opposite the first end. The extension nipple 903 can be coupled to a tub spout by screwing the tub spout onto the threaded portion of the extension nipple 903. The tub spout can include a threaded hole in which the threaded portion is screwed into.

Figure 10B:
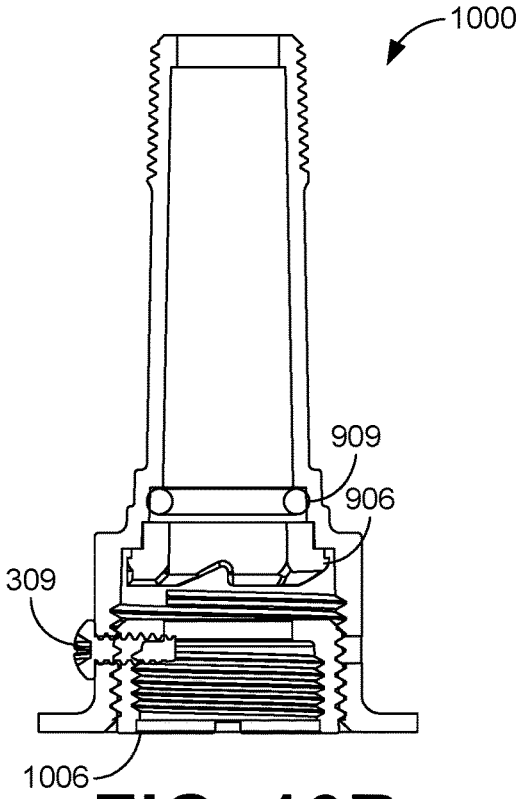
FIG. 10B illustrates a cross-sectional view of a tub spout coupling mechanism according to various embodiments of the present disclosure.

With reference to FIG. 10B, shown is a cross-sectional view of the spout coupling mechanism 1000 according to various embodiments of the present disclosure. The O-ring 909 can be positioned between the adaptor nipple 1003 and the spin weld retaining ring 906. A screw 309 can screw into the adaptor nipple 1003 to contact the pipe 103. A bushing 1006 can be coupled to an end of the adaptor nipple 1003. The adaptor nipple 1003 can include threads on a first end and bushing threads on a second end opposite the first end.

The bushing 1006 can include threads. The bushing 1006 can be screwed into the bushing threads of the adaptor nipple 1003. In some embodiments, the bushing 1006 can be a half inch female tapered pipe thread to one inch male tapered pipe thread bushing, a three quarter inch female tapered pipe thread to one inch male tapered pipe thread bushing, or another bushing. The spin weld retaining ring 906 can contact an internal portion of the adaptor nipple 1003. The O-ring 909 can form a seal between the adaptor nipple 1003 and the spin weld retaining ring 906.

Figure 10C:
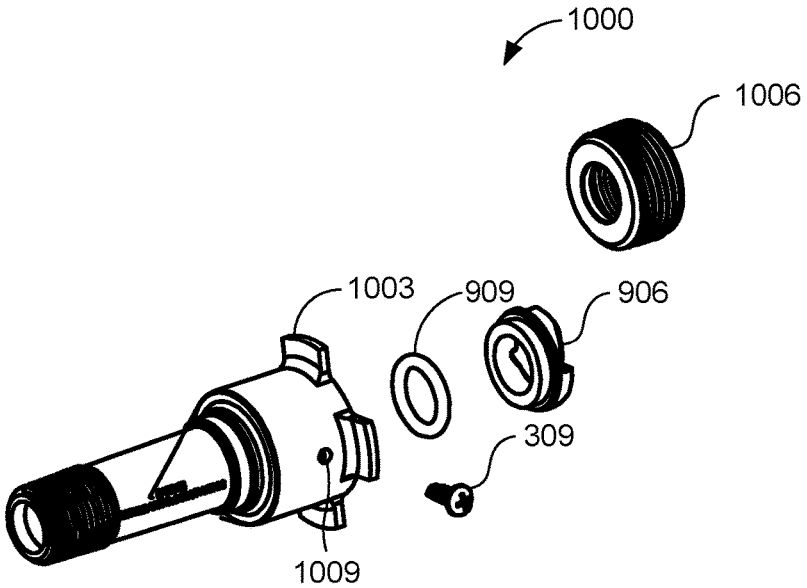
FIG. 10C illustrates an exploded view of a tub spout coupling mechanism according to various embodiments of the present disclosure.

With reference to FIG. 10C, shown is an exploded view of the spout coupling mechanism 1000 according to various embodiments of the present disclosure. The adaptor nipple 1003 can include aperture 1009 that the screw 309 screws into. The O-ring 909 can be inserted into an opening of the adaptor nipple 1003. Next, the spin weld retaining ring 906 can be inserted into the opening of the adaptor nipple 1003. The spin weld retaining ring 906 can weld against an inner surface of the adaptor nipple 1003 to hold the spin weld retaining ring 906 in place. The spin weld retaining ring 906 can hold the O-ring 909 in place relative to the adaptor nipple 1003. The bushing 1006 can be screwed into the opening of the adaptor nipple 1003. In some embodiments, the bushing can include a hole or missing portion that the screw 309 can pass through to contact the pipe 103.

Figure 11A:
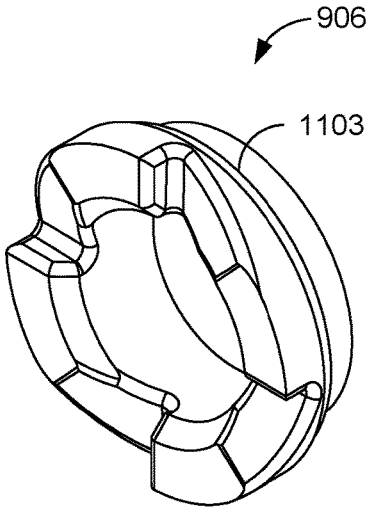
FIG. 11A illustrates a perspective view of a spin weld retaining ring according to various embodiments of the present disclosure.

With reference to FIG. 11A, shown is a perspective view of the spin weld retaining ring 906 according to various embodiments of the present disclosure. The spin weld retaining ring 906 can include an edge 1103. The edge 1103 can contact an inside surface of the extension nipple 903 or adaptor nipple 1003. The edge 1103 can provide a weld surface pressure against the inside surface such that a force would be required to pull the spin weld retaining ring 906 out of the extension nipple 903 or the adaptor nipple 1003. The spin weld retaining ring 906 can prevent an O-ring 909 from being removed from the extension nipple 903 or the adaptor nipple 1003.

Figure 11B:
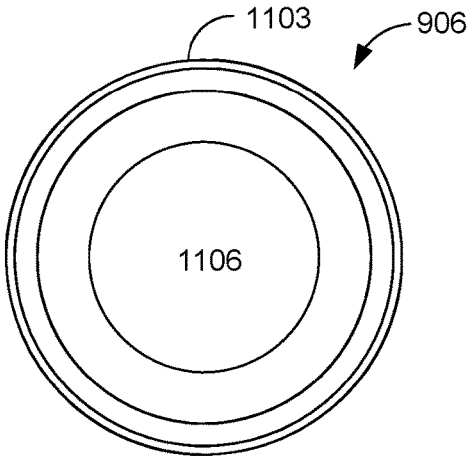
FIG. 11B illustrates a top view of a spin weld retaining ring according to various embodiments of the present disclosure.

With reference to FIG. 11B, shown is a top view of the spin weld retaining ring 906 according to various embodiments of the present disclosure. The spin weld retaining ring 906 can include an aperture 1106. A diameter of the aperture 1106 can be greater than that of the pipe 103 such that the pipe can pass through the aperture 1106.

Figure 11C:
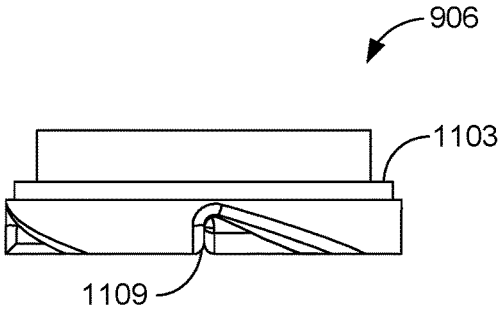
FIG. 11C illustrates a side view of a spin weld retaining ring according to various embodiments of the present disclosure.

With reference to FIG. 11C, shown is a side view of the spin weld retaining ring 906 according to various embodiments of the present disclosure. The spin weld retaining ring 906 can include one or more clocking mechanisms 1109 that can generate outward pressure at the edge 1103. The outward pressure increases a static friction between the edge 1103 and an inside surface of the extension nipple 903 or the adaptor nipple 1003.

Figure 11D:
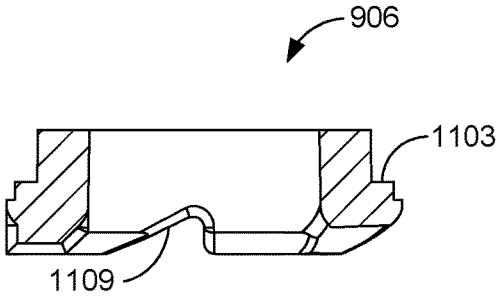
FIG. 11D illustrates a cross-sectional side view of a spin weld retaining ring according to various embodiments of the present disclosure.

With reference to FIG. 11D, shown is a cross-sectional side view of the spin weld retaining ring 906 according to various embodiments of the present disclosure. The spin weld retaining ring 906 can securely retain the O-ring 909. The spin weld retaining ring 906 can be positioned in an opening of the extension nipple 903 or the adaptor nipple 1003. The spin weld retaining ring 906 can be held in place by means of friction welding, including a combination of temperature, heat, pressure, rotating speed, ultrasonics, and time between the retaining ring 906 and the extension nipple 903 or the adaptor nipple 1003. The spin weld retaining ring 906 can be coupled to the extension nipple 903 or the adaptor nipple 1003 by spin welding, heat staking, ultrasonic welding, glued, or other method.

Figure 12A:
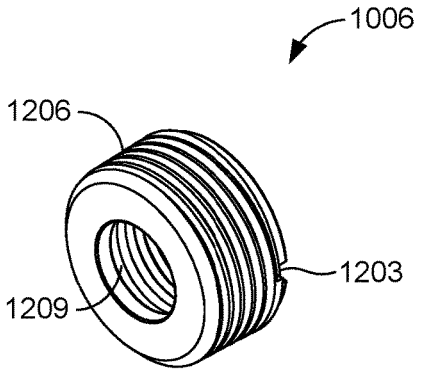
FIG. 12A illustrates a perspective view of a bushing according to various embodiments of the present disclosure.

With reference to FIG. 12A, shown is a perspective view of the bushing 1006 according to various embodiments of the present disclosure. The bushing 1006 can include one or more notches 1203. In some embodiments, the notches 1203 can correspond to holes. The bushing 1006 can include outer threads 1206 and inner threads 1209. The outer threads 1206 can be screwed into the adaptor nipple 1003.

Figure 12B:
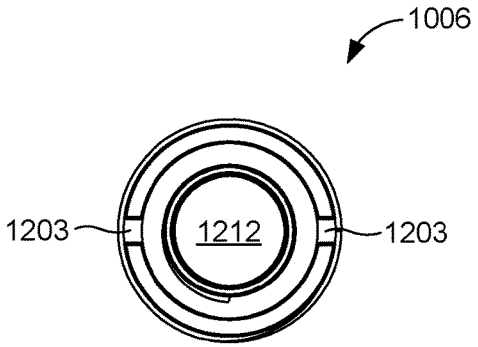
FIG. 12B illustrates a top view of a bushing according to various embodiments of the present disclosure.

With reference to FIG. 12B, shown is a top view of the bushing 1006 according to various embodiments of the present disclosure. Two notches 1203 can be positioned opposite one another. The bushing 1006 can include an aperture 1212 with a diameter greater than that of the pipe 103 and extension nipple 1603.

Figure 12C:
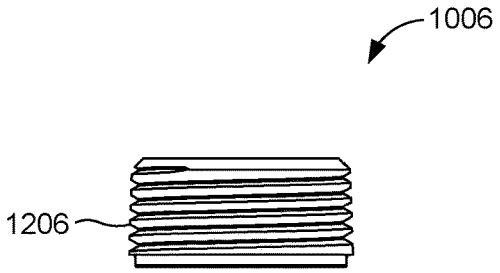
FIG. 12C illustrates a side view of a bushing according to various embodiments of the present disclosure.

With reference to FIG. 12C, shown is a side view of the bushing 1006 according to various embodiments of the present disclosure. The outer threads 1206 can match bushing threads on an inside of an opening of the adaptor nipple 1003 and extension nipple 1603.

Figure 12D:
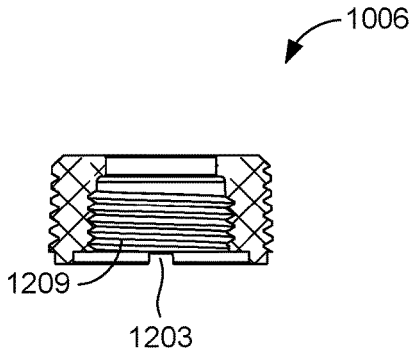
FIG. 12D illustrates a cross-sectional side view of a bushing according to various embodiments of the present disclosure.

With reference to FIG. 12D, shown is a cross-sectional side view of the bushing 1006 according to various embodiments of the present disclosure. The bushing 1006 can have inner threads 1209 such that another structure can be screwed into the mechanism 1000. As an example, a National Pipe Threads (NPT) nipple can be screwed into the inner threads 1209. More than one bushing 1006 can be available with each bushing corresponding to a different inner thread 1209. As an example, a first bushing 1006 can be a half inch female NPT to one inch male NPT bushing while a second bushing 1006 can be a three quarter inch female NPT to one inch male NPT bushing. One of the bushings 1006 can be selected based on whether a three quarter inch NPT or half inch NPT nipple is being used to couple to the NPT pipe.

Figure 13A:
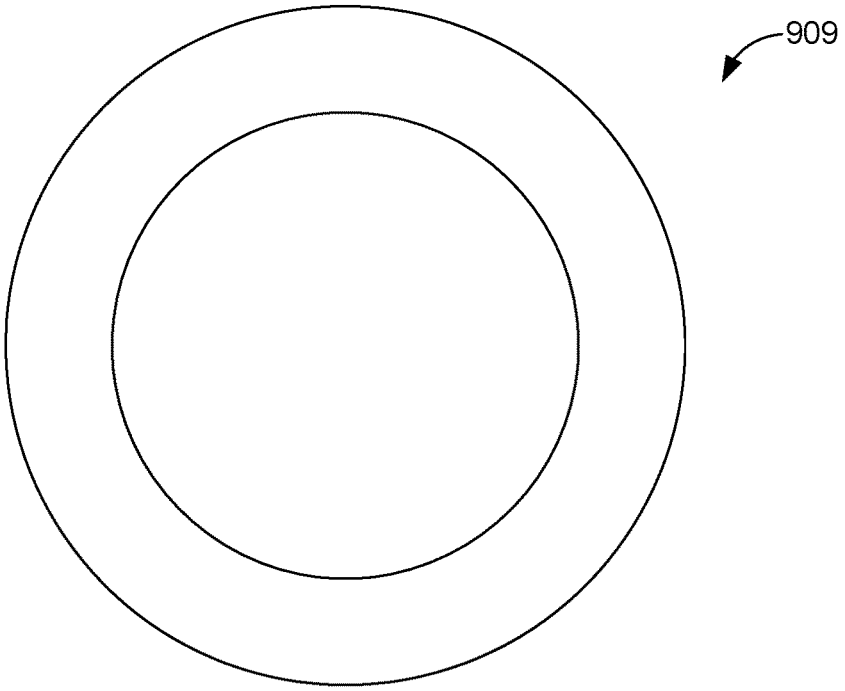
FIG. 13A illustrates a top view of an O-ring according to various embodiments of the present disclosure.

With reference to FIG. 13A, shown is a top view of the O-ring 909 according to various embodiments of the present disclosure. The O-ring 909 can be made from an NSF 61 certified RT Dygert EPDM E-7020, a Maifeng EPDM EP7118F, or another material. The O-ring 909 can be chloramine resistant. The O-ring 909 can have a durometer of 65 to 75 Shore A. The O-ring 909 can be a circle with a diameter.

Figure 13B:
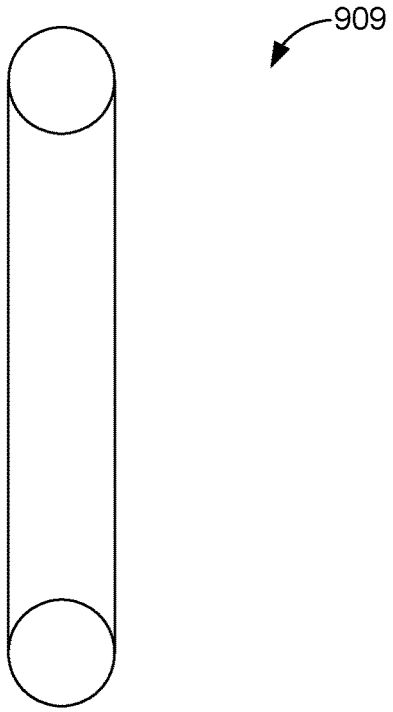
FIG. 13B illustrates a side cross-sectional view of an O-ring according to various embodiments of the present disclosure.

With reference to FIG. 13B, shown is a side cross-sectional view of the O-ring 909 according to various embodiments of the present disclosure. The O-ring 909 can correspond to a cylindrical material wrapped to form a circle.

Figure 14A:
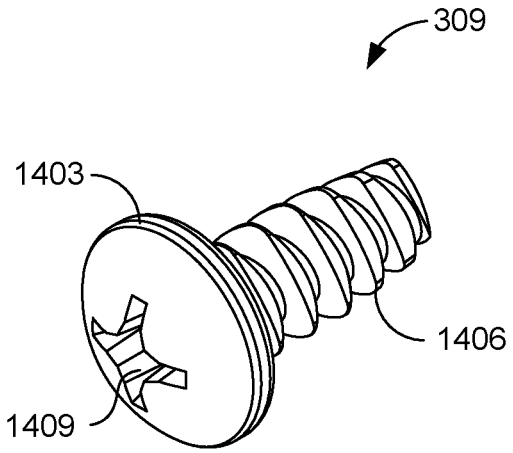
FIG. 14A illustrates a perspective view of a screw according to various embodiments of the present disclosure.

With reference to FIG. 14A, shown is a perspective view of the screw 309 according to various embodiments of the present disclosure. The screw 309 can include a head 1403 and a thread 1406. The head 1403 can include a notch 1409. The notch 1409 can correspond to a slot drive, a coin slot drive, a cross drive, a Philips drive, a Robertson drive, a torx drive, a hex drive, or some other drive head. In some embodiments, the threads 1406 can correspond to a #8-16 thread.

Figure 14B:
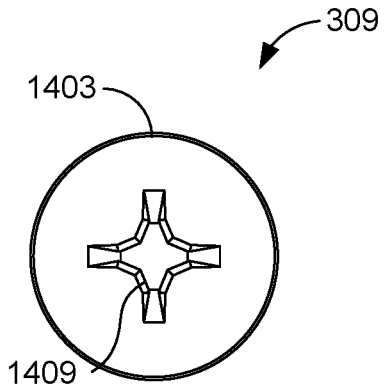
FIG. 14B illustrates a top view of the screw according to various embodiments of the present disclosure.

With reference to FIG. 14B, shown is a top view of the screw 309 according to various embodiments of the present disclosure. The head 1403 can be a circle with a diameter.

Figure 14C:
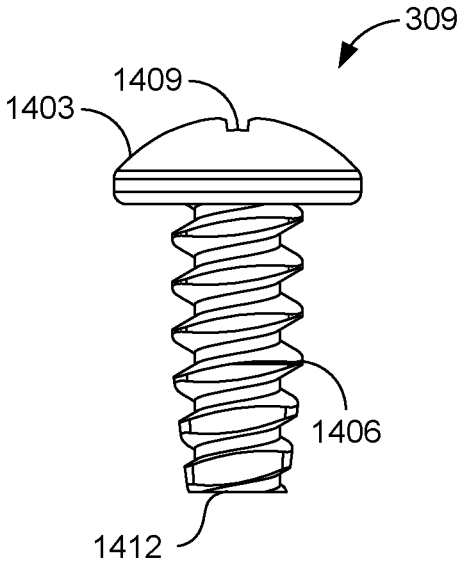
FIG. 14C illustrates a side view of the screw according to various embodiments of the present disclosure.

With reference to FIG. 14C, shown is a side view of the screw 309 according to various embodiments of the present disclosure. The screw 309 can include a flat bottom 1412. As an example, the screw 309 can be a machine screw.

Figure 14D:
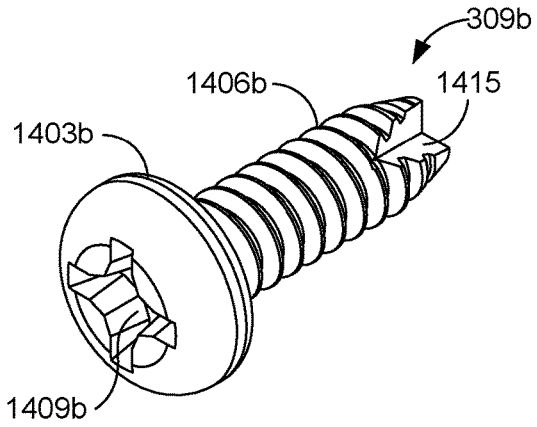
FIG. 14D illustrates a perspective view of another screw according to various embodiments of the present disclosure.

With reference to FIG. 14D, shown is a perspective view of the screw 309*b* according to various embodiments of the present disclosure. The screw 309*b* is similar to the screw 309 except as noted otherwise. The screw 309*b* can include a head 1403*b* and a thread 1406*b*. The head 1403*b* can include a notch 1409*b*. The notch 1409 can correspond to a slot drive, a coin slot drive, a cross drive, a Philips drive, a Robertson drive, a torx drive, a hex drive, or some other drive head. In some embodiments, the threads 1406 can correspond to a #8-18 thread.

A notch 1415 can be removed from screw 309*b*. The notch 1415 can create a sharp edge on the end of the screw 309*b*. When the screw 309*b* is screwed in, the sharp edge resulting from the notch 1415 can cut away any burrs or other material blocking the thread from turning.

Figure 14E:
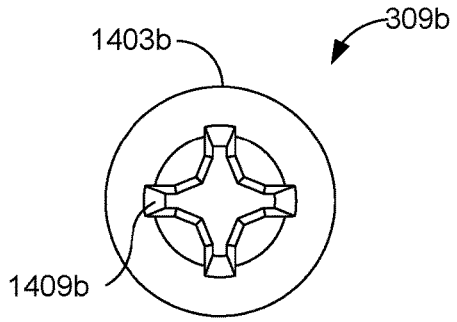
FIG. 14E illustrates a top view of the other screw according to various embodiments of the present disclosure.

With reference to FIG. 14E, shown is a top view of the screw 309*b* according to various embodiments of the present disclosure. The head 1403*b* can be a circle with a diameter.

Figure 14F:
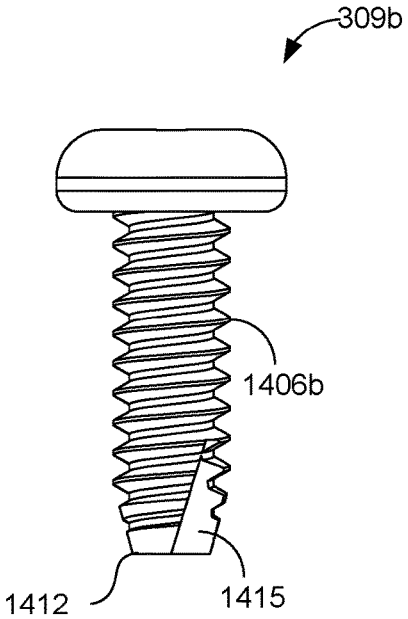
FIG. 14F illustrates a side view of the other screw according to various embodiments of the present disclosure.

With reference to FIG. 14F, shown is a side view of the screw 309*b* according to various embodiments of the present disclosure. The screw 309*b* can include a flat bottom 1412. As an example, the screw 309*b* can be a machine screw. An edge associated with the notch 1415 can remove any debris in the bore hole that the screw 309*b* is screwed into. The flat bottom 1412 can prevent the screw 309*b* from penetrating any material that does not have a bore hole. Rather, the flat bottom 1412 can apply a pressure against any material contacted that does not have a bore hole, such as, for example, a pipe.

Figure 14G:
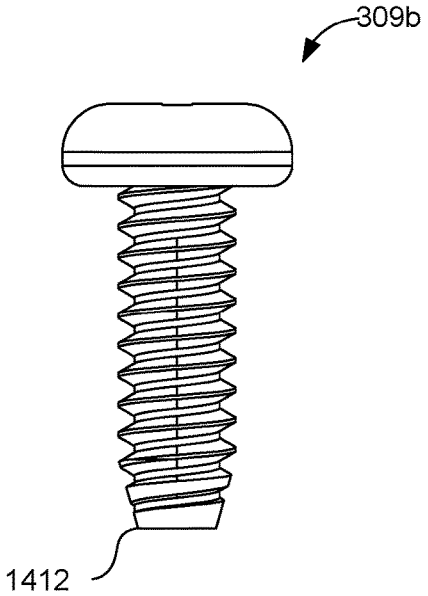
FIG. 14G illustrates another side view of the other screw according to various embodiments of the present disclosure.

With reference to FIG. 14G, shown is a side view of the screw 309*b* according to various embodiments of the present disclosure. The side view of FIG. 14G can correspond to the side view of FIG. 14F rotated 180 degrees. The notch 1415 is hidden from view because of the rotation of the screw 309*b*.

Figure 15A:
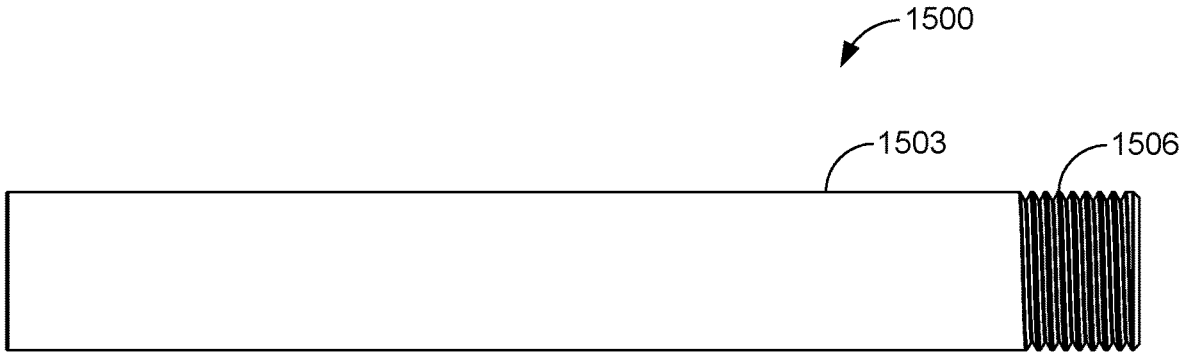
FIG. 15A illustrates a side view of a threaded pipe according to various embodiments of the present disclosure.

With reference to FIG. 15A, shown is a side view of a threaded pipe 1500 according to various embodiments of the present disclosure. The threaded pipe 1500 can be a threaded NPT pipe. The threaded pipe 1500 can include a pipe portion 1503 and a threaded portion 1506. The threaded pipe 1500 can be formed by generating a thread on an end of the pipe 1503 to add the threaded portion 1506, such as, for example, using a thread die. The threaded portion 1506 can be screwed into a female NPT socket. As an example, the threaded portion 1506 can be screwed into the inner threads 1209 (FIG. 12) of the bushing 1006 (FIG. 10). The pipe portion 1503 can be of varying lengths.

Figure 15B:
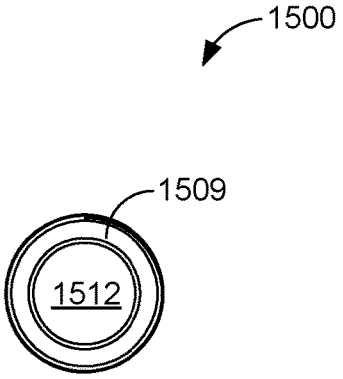
FIG. 15B illustrates an end view of a threaded pipe according to various embodiments of the present disclosure.

With reference to FIG. 15B, shown is an end view of the threaded pipe 1500. The threaded pipe 1500 can have an inner and outer diameter forming a thickness 1509. An aperture 1512 can pass through the center of the threaded pipe 1500. A substance, such as water or gas, can pass through the aperture. The substance can be pressurized in the threaded pipe 1500.

Figure 16A:
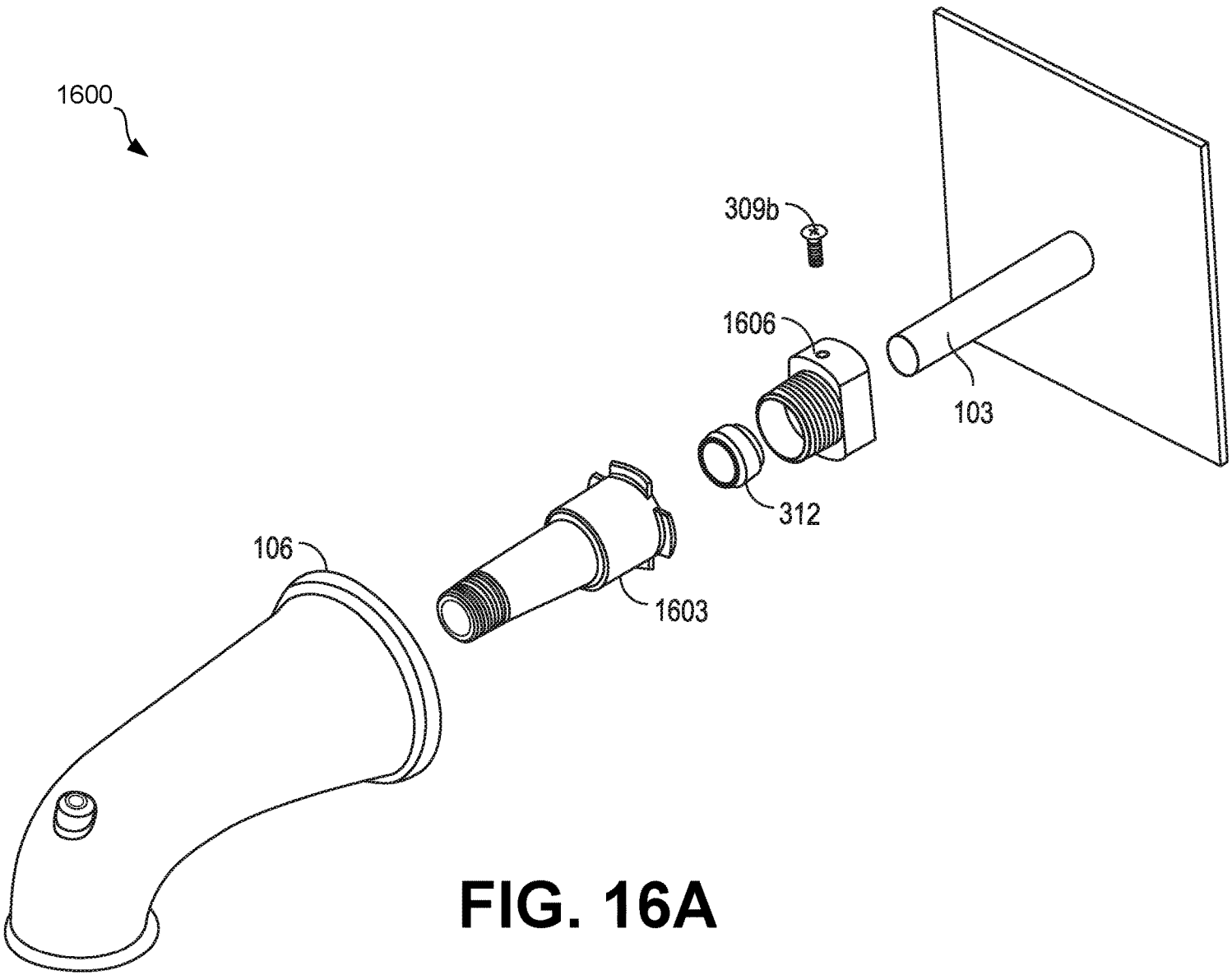
FIG. 16A illustrates an exploded view of a tub spout assembly according to various embodiments of the present disclosure.

Turning to FIG. 16A, shown is an exploded view of a tub spout assembly 1600 according to various embodiments of the present disclosure. The tub spout assembly 1600 can include a pipe 103 coupled to a tub spout 106 via an extension nipple 1603, an extension nipple adaptor 1606, a screw 309*b*, and a compression ring 312. The extension nipple adaptor 1606 can slide onto the pipe 103. The compression ring 312 can slide onto the pipe 103 after the extension nipple adaptor 1606.

The extension nipple 1603 can slide onto the pipe 103 and screwed onto the extension nipple adaptor 1606. In some embodiment, the extension nipple 1603 can be hand tightened onto the extension nipple adaptor 1606. The screw 309*b* can be inserted into the extension nipple adaptor 1606. The screw 309*b* can make contact with the pipe 103. The tub spout 106 can be screwed into the extension nipple 1603. The tub spout 106 can be threaded fully until substantially flush with a wall.

Figure 16B:
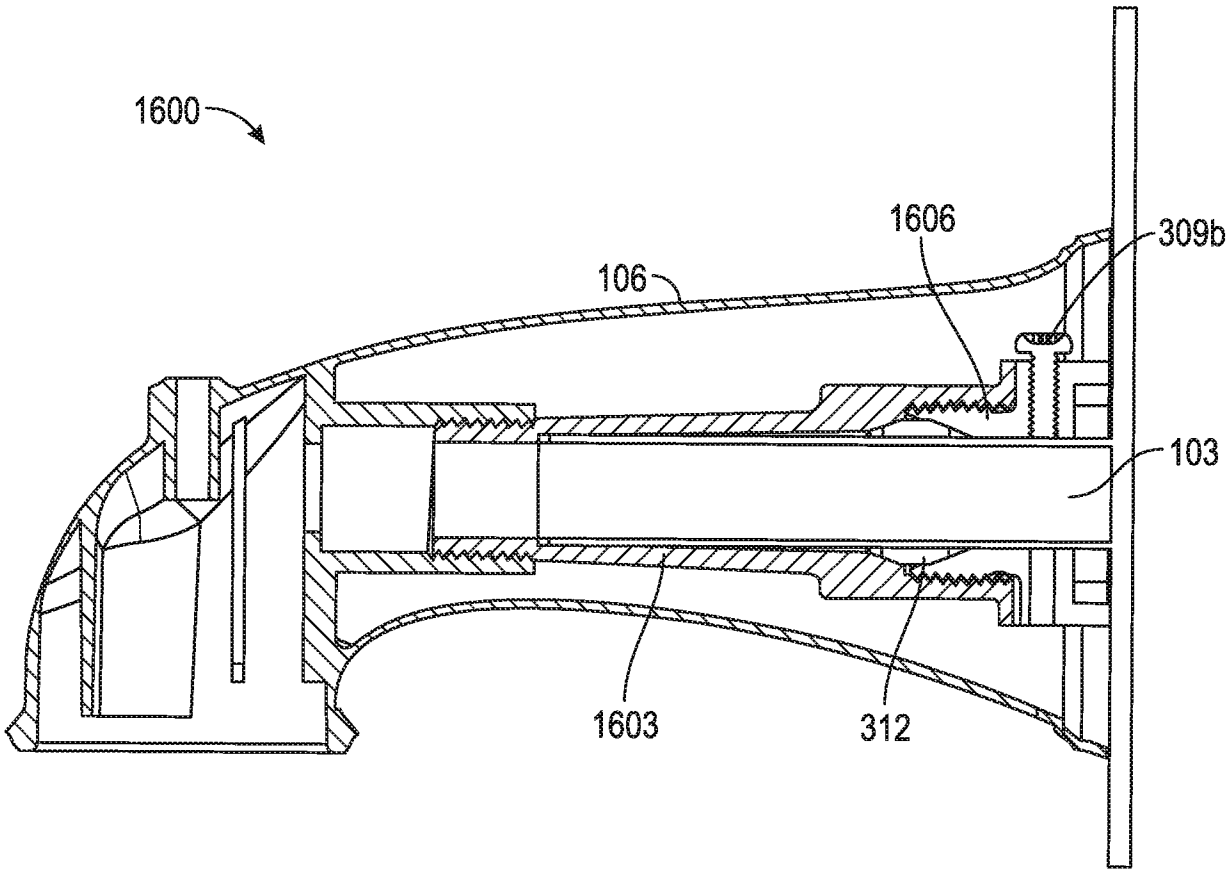
FIG. 16B illustrates a cross sectional view of a tub spout assembly according to various embodiments of the present disclosure.

With reference to FIG. 16B, shown is a cross-section of the tub spout assembly 1600 of FIG. 16A assembled according to various embodiments of the present disclosure. As shown, the compression ring 312 is pinched between the extension nipple 1603 and the extension nipple adaptor 1606. Both the extension nipple 1603 and the extension nipple adaptor 1606 can have an inclined plane that contacts a surface of the compression ring 312. The inclined plane can cause the compression of the compression ring 312 to increase as the extension nipple 1603 is tightened on the extension nipple adaptor 1606.

Figure 17A:
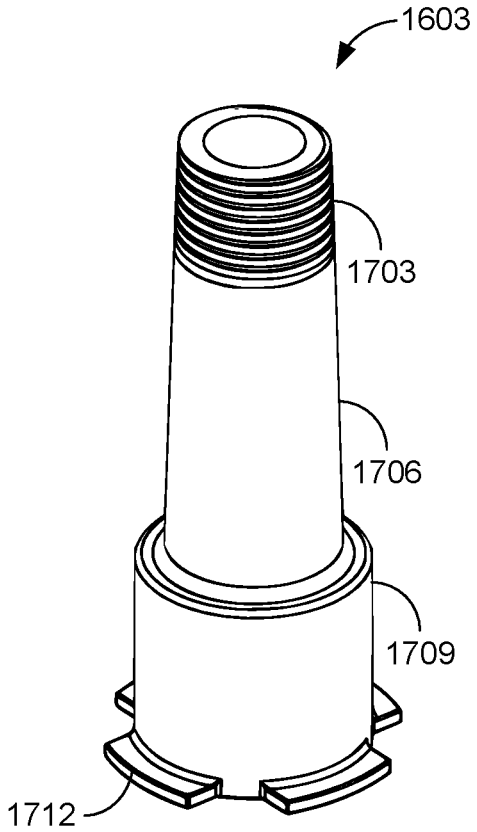
FIG. 17A illustrates a perspective view of an extension nipple according to various embodiments of the present disclosure.

With reference to FIG. 17A, shown is a perspective view of an extension nipple 1603 according to various embodiments of the present disclosure. The extension nipple 1603 can include threads 1703, an extension shaft 1706, a bell housing 1709, and one or more tabs 1712. The extension nipple 1603 can be slide over a pipe 103 and screwed onto an extension nipple adaptor 1606. A tub spout 106 can be screwed onto the threads 1703. In some embodiments, the tabs 1712 can be omitted. In some embodiments, the extension nipple 1603 is hand tightened onto the extension nipple adaptor 1606.

Figure 17B:
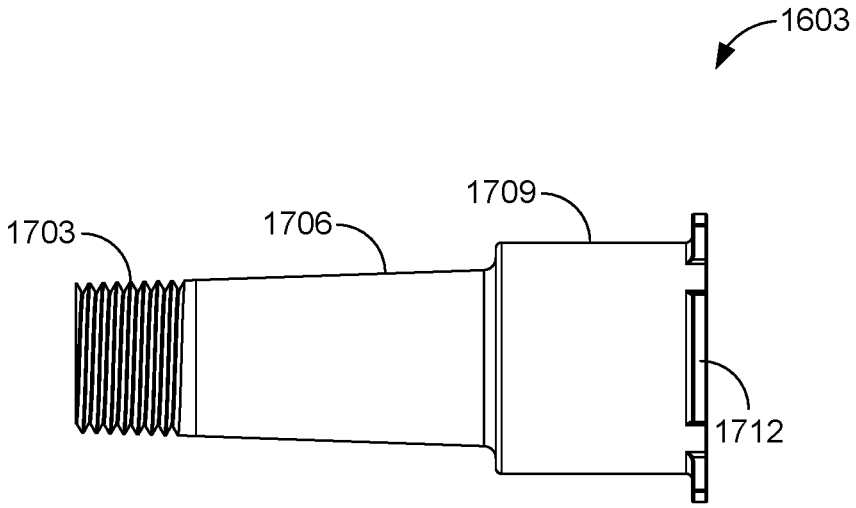
FIG. 17B illustrates a side view of the extension nipple according to various embodiments of the present disclosure.

With reference to FIG. 17B, shown is a side view of the extension nipple 1603 according to various embodiments of the present disclosure.

Figure 17C:
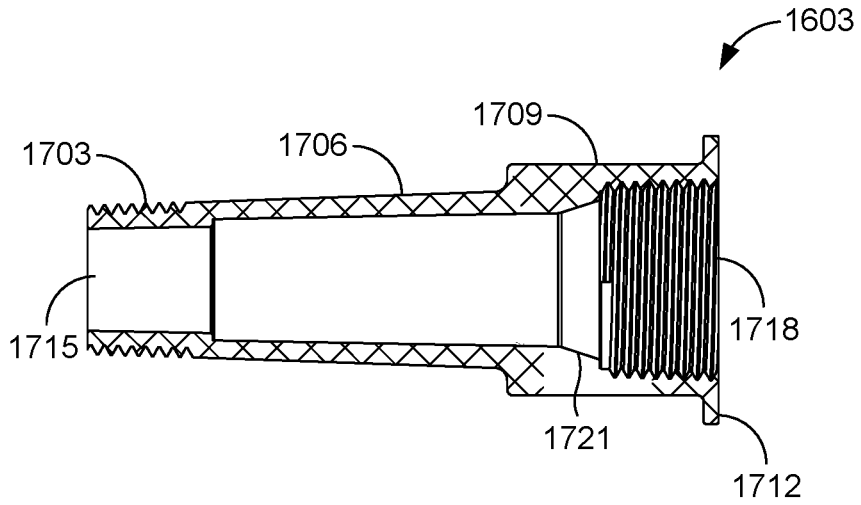
FIG. 17C illustrates a cross-sectional side view of the extension nipple according to various embodiments of the present disclosure.

With reference to FIG. 17C, shown is a cross-sectional side view of the extension nipple 1603 according to various embodiments of the present disclosure. The extension nipple 1603 can include an aperture 1715, threads 1718 in the bell housing 1709, and an angled surface 1721. The aperture 1715 can pass through a length of the extension nipple 1603. When in use, water can pass through the aperture 1715. The water can come out of the end of the aperture 1715 and exit the tub spout 106. During manufacturing, the tabs 1712 can be used to hold the extension nipple 1603 in place, such as, for example, when creating the internal threads 1718. The threads 1718 can be screwed onto the extension nipple adaptor 1606. The compression ring 312 can be compressed between the extension nipple 1603 and the extension nipple adaptor 1606. When tightened, the angled surface 1721 can apply a force on the compression ring 312. The force can have a downward (down onto the pipe 103) component and a forward component (toward the extension nipple adaptor 1606).

Figure 17D:
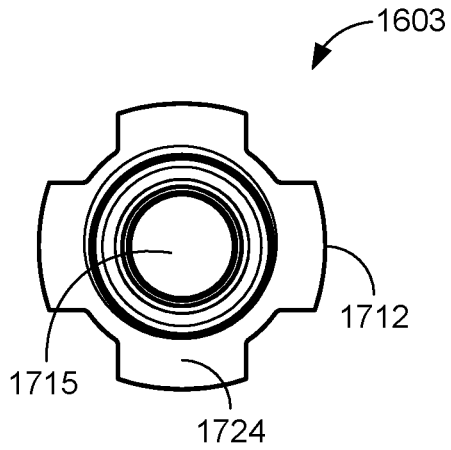
FIG. 17D illustrates a bottom view of the extension nipple according to various embodiments of the present disclosure.

With reference to FIG. 17D, shown is a bottom view of the extension nipple 1603 according to various embodiments of the present disclosure. The extension nipple 1603 can include a flat surface 1724 of the tabs 1712.

Figure 18A:
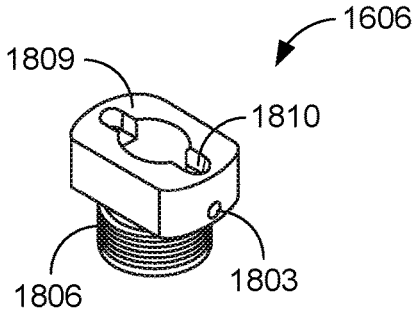
FIG. 18A illustrates a perspective view of an extension nipple adaptor according to various embodiments of the present disclosure.

Turning to FIG. 18A, shown is a perspective view of an extension nipple adaptor 1606 according to various embodiments of the present disclosure. The extension nipple adaptor 1606 can include one or more apertures 1803, threads 1806, a flat surface 1809, and a slot 1810. The flat surface 1809 can be positioned against a wall with the extension nipple adaptor 1606. The aperture 1803 can have a diameter slightly smaller than the diameter of a threaded portion of a screw 309*b*. The screw 309*b* can be screwed into the aperture 1803. In some embodiments, the extension nipple adaptor 1606 can have threads bored into the aperture 1803. In some embodiments, a slot 1810 can be made in the flat surface 1809. The slot 1810 can reduce the amount of material used during manufacturing, which can reduce a weight of the extension nipple adaptor 1606.

Figure 18B:
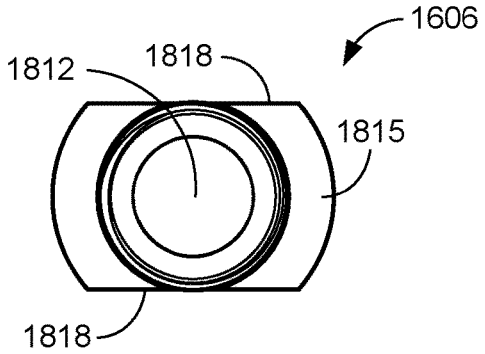
FIG. 18B illustrates a bottom view of the extension nipple adaptor according to various embodiments of the present disclosure.

With reference to FIG. 18B, shown is a bottom view of the extension nipple adaptor 1606 according to various embodiments of the present disclosure. The extension nipple adaptor 1606 can include an aperture 1812, a flat surface 1815, and a flat edge 1818. A pipe 103 can be inserted through the aperture 1812. The flat surface 1815 can abut a flat surface 1724 (FIG. 17D) of the extension nipple 1603 (FIG. 16) when the tub spout assembly 1600 is installed. A wrench, such as a crescent wrench, can be used to tighten the extension nipple adaptor 1606. The wrench can apply a torque on the extension nipple adaptor 1606 via the flat edges 1818.

Figure 18C:
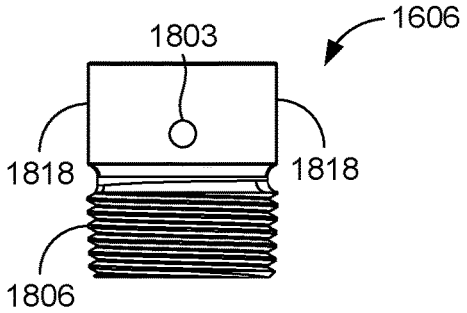
FIG. 18C illustrates a side view of the extension nipple adaptor according to various embodiments of the present disclosure.

With reference to FIG. 18C, shown is a side view of the extension nipple adaptor 1606 according to various embodiments of the present disclosure.

Figure 18D:
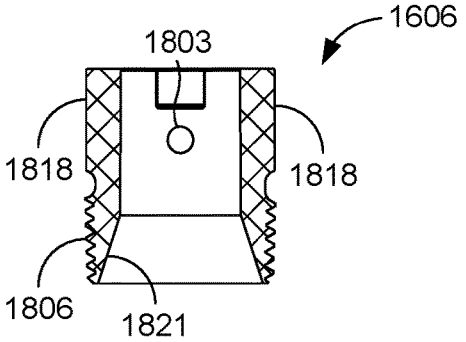
FIG. 18D illustrates a cross-sectional side view of the extension nipple adaptor according to various embodiments of the present disclosure.

With reference to FIG. 18D, shown is a cross-sectional side view of the extension nipple adaptor 1606 according to various embodiments of the present disclosure. The extension nipple adaptor 1606 can include an angled surface 1821. The angled surface 1821 can function as an inclined plane when in contact with the compression ring 312. The angled surface 1821 can apply a force on the compression ring 312, where the force has a downward component and a forward component.

Figure 18E:
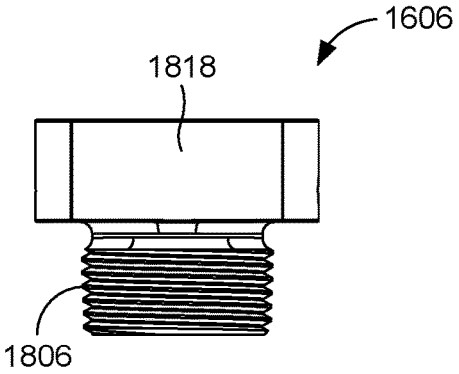
FIG. 18E illustrates another side view of the extension nipple adaptor according to various embodiments of the present disclosure.

With reference to FIG. 18E, shown is another side view of the extension nipple adaptor 1606 rotated ninety degrees from FIG. 18C according to various embodiments of the present disclosure.

Figure 18F:
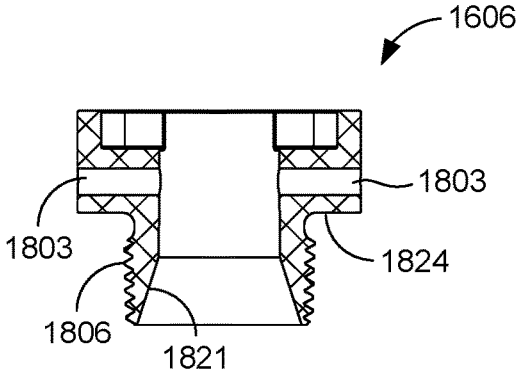
FIG. 18F illustrates a cross-sectional view of the other side of the extension nipple adaptor according to various embodiments of the present disclosure.

With reference to FIG. 18F, shown is another cross-sectional side view of the extension nipple adaptor 1606 rotated ninety degrees from FIG. 18D according to various embodiments of the present disclosure. The extension nipple adaptor 1606 can include an aperture 1803 on opposite sides such that a screw can be inserted in either side or both. In some embodiments, additional apertures 1803 are included. When installing the extension nipple adaptor 1606, one or more of the apertures 1803 may be inaccessible based on the installation environment. By having additional apertures 1803, if one aperture 1803 is inaccessible, the screw 309*b* can be inserted in a different aperture 1803.

Figure 18G:
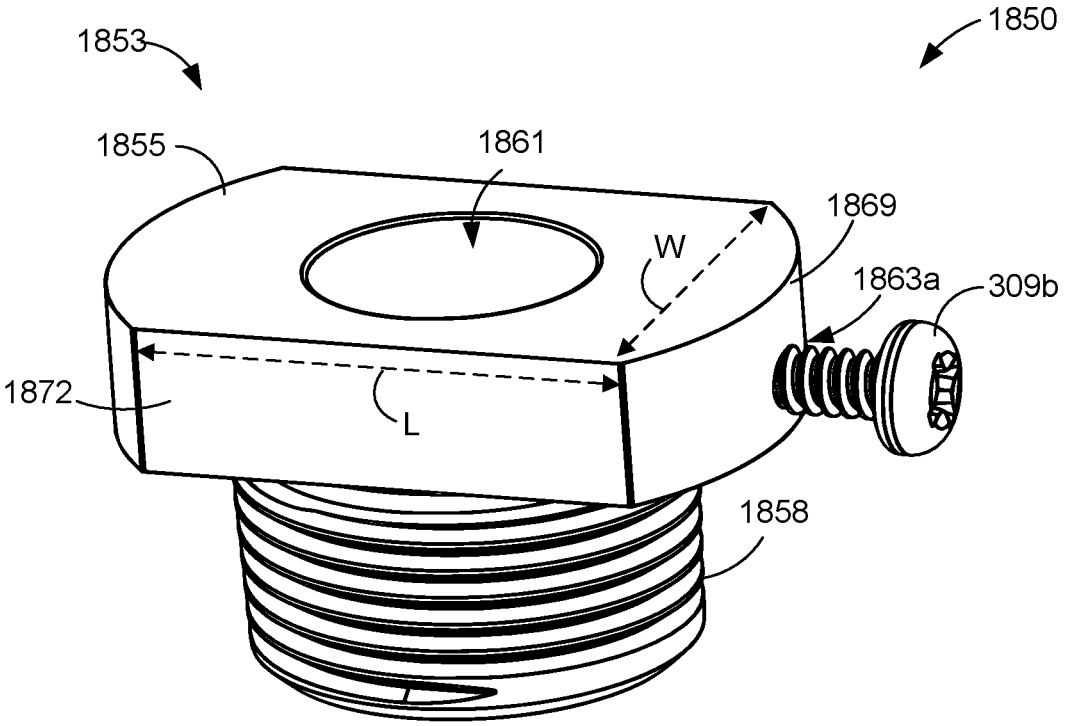
FIG. 18G illustrates a perspective view of an extension nipple adapter assembly according to various embodiments of the present disclosure.

Turning to FIG. 18G, shown is a perspective view of an extension nipple adapter assembly 1850 according to various embodiments of the present disclosure. The extension nipple adapter assembly 1850 includes a second extension nipple adapter 1853 and the screw 309*b*. The second extension nipple adapter 1850 has many similar aspects to the extension nipple adaptor 1606 shown in FIGS. 16A and 16B, FIGS. 18A-18F, and FIGS. 19A-19J. With regard to the discussion of FIGS. 18G-18I, some of the common aspects with the extension nipple adaptor 1606 may be omitted.

The extension nipple adapter assembly 1850 can be used to attach the second extension nipple adapter 1853 to the pipe 103 (FIG. 16A) without the screw 309*b* making direct contact with the pipe 103. In some instances, the screw 309*b* can damage the pipe 103 by making direct contact. In the illustrated embodiment, the second extension nipple adapter 1853 includes an adapter head 1855 that extends from a threaded rod 1858. The second extension nipple adapter 1853 has a pipe aperture 1861 that extends through the adapter head 1855 and the threaded rod 1858.

The adapter head 1855 includes a first fastener aperture 1863*a* and a second fastener aperture 1863*b* (not shown) (collectively "the fastener apertures 1863"). The fastener apertures 1863 are positioned on curved sides 1869 of the adapter head 1855, in which the curved sides 1869 are on opposing sides of the adapter head 1855. The curved sides 1869 are connected to the flat sides 1872. The width "W" of the curved sides 1869 is less than the length "L" of the flat sides 1872. One skilled in the art can appreciate that the shape of the adapter head 1855 can vary. For example, the adapter head 1855 can have a circular shape, a rectangular shape, and other suitable shapes.

Similar to the embodiments shown in FIGS. 16A and 16B, the extension nipple adapter assembly 1850 can used to couple to a tub spout 106 to a pipe 103. In one scenario, the extension nipple adapter assembly 1850 represents an alternative configuration in which the screw 309*b* can be pre-installed in the second extension nipple adapter 1853. In this scenario, during installation, the operator can omit the step of inserting the screw 309*b* into the second extension nipple adapter 1853. Instead, after the second extension nipple adapter 1853 is positioned around the pipe 103 and against the wall through which the pipe extends, the operator can tighten the screw 309*b* into the second extension nipple adapter 1853. In other scenarios, the second extension nipple adapter 1853 and the screw 30*b* may be unassembled and provided separately.

Figure 18H:
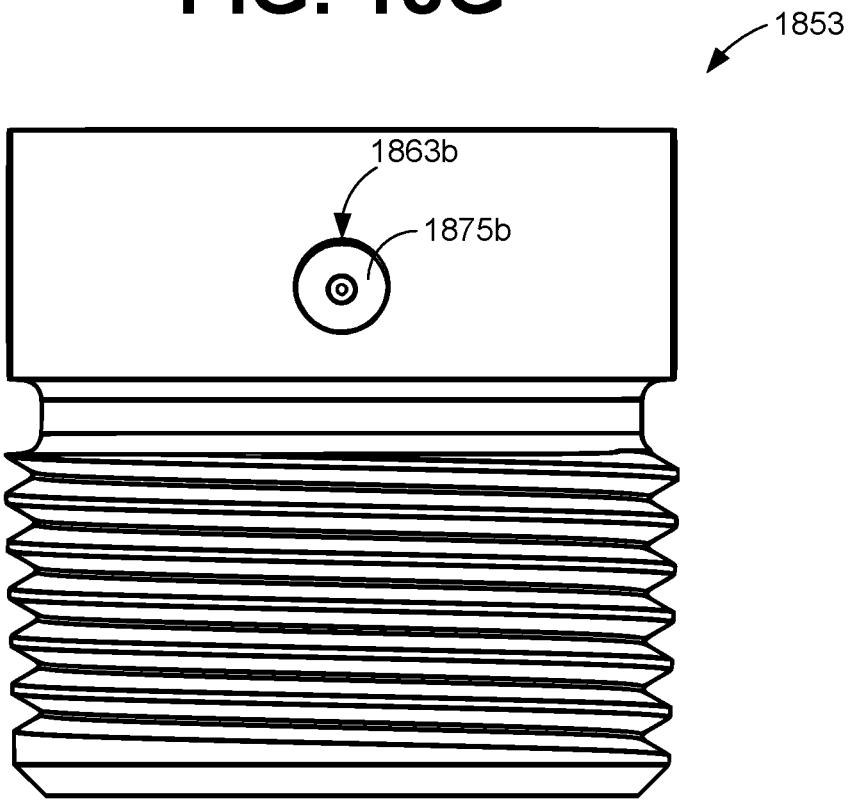
FIG. 18H illustrates a side view of the second extension nipple adapter from FIG. 18G according to various embodiments of the present disclosure.

With reference to FIG. 18H, shown is a side view of the second extension nipple adapter 1853. From the side view, the second fastener aperture 1863*b* is shown, in which a second knock-out 1875*b* is visible within the second fastener aperture 1863*b*. The first knock-out (FIG. 18G) (collectively the "knock-outs 1863") is accessible within the first fastener aperture 1863*a* (FIG. 18G and. The knock-outs 1875 can be used to attach the second extension nipple adapter 1853 to the pipe 103, which is positioned within the pipe aperture 1861.

Figure 18I:
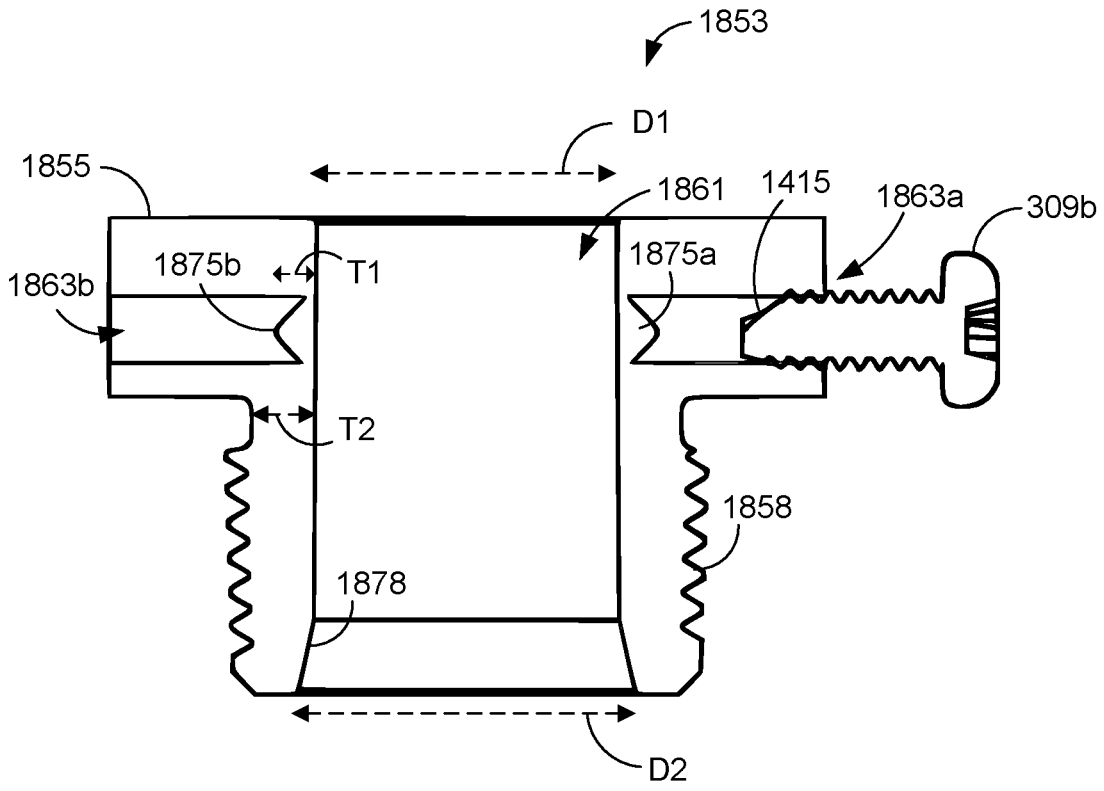
FIG. 18I illustrates a cross-sectional view of the extension nipple adapter assembly from FIG. 18G assembly according to various embodiments of the present disclosure.

Moving on to FIG. 18I, shown is a cross-sectional view of the extension nipple adapter assembly 1850 from FIG. 18G. FIG. 18I illustrates that the pipe aperture 1861 has a first diameter "D1" at the adapter head 1855 and the pipe aperture 1861 has a second diameter "D2" at the end of the threaded rod 1858. In the illustrated embodiment, the second diameter "D2" is larger than the first diameter "D1." Further, the end of the threaded rod 1858 has a tapered surface 1878 that forms the second diameter "D2."

FIG. 18I also illustrates the first knock-out 1875*a* and the second knock-out 1875*b* of the second extension nipple adapter 1853. In this illustrated embodiment, the knock-outs 1875 have a conical shape, in which the conical shape is pointed away from the center of the second extension nipple adapter 1853. The knock-outs 1875 extend from the interior wall that forms the pipe aperture 1861. One skilled in the art would appreciate that the shape of the knock-out 1875 can vary.

Additionally, the knock-outs 1875 have a first thickness "T1" from the interior wall to the farthest point of the knockout-out 1875. In the illustrated embodiment, the thickness of the knock-out 1875 decreases away from farthest point because of its conical shape. The threaded rod 1858 has a second thickness "T2," which is larger than the first thickness "T1." The smaller thickness "T1" for the knock-outs 1875 makes it earlier for the knock-outs 1875 to be displaced by the screw 309*b*. Particularly, the screw 309*b* can separate the knock-out 1875 from the interior wall of the pipe aperture 1861 and move the knock-out 1875 toward the interior of the second extension nipple adapter 1853. Thus, the knock-out 1875 can be separated from the interior wall and apply a force against the surface of the pipe 103 in order to attach the second extension nipple adapter 1853 to the pipe 103. Accordingly, the knock-out 1875 is positioned between the surface of the pipe 103 and the screw 309*b*. By using a knock-out 1875 as the connection point with the pipe 103, the screw 309 will not damage the pipe 103 as the screw 309 is used to fasten the second extension nipple adapter 1853 to the pipe 103.

In some embodiments, the screw 309*b* has a notch 1415, which is created by removing a portion of the material from the screw 309*b*. The notch 1415 can create a sharp edge on the end of the screw 309*b*. When the screw 309*b* is screwed in, the sharp edge resulting from the notch 1415 can cut away peripheral portions of the knock-out 1875.

Turning to FIGS. 19A-K, shown are various stages of installing the tub spout assembly 1600, which is shown as tub spout assembly 1600*a-k*. As an alternative, the flowchart of FIGS. 19A-K may be viewed as depicting an example of elements of a method of installing a tub spout assembly 1600 according to one or more embodiments. It is noted that embodiments described herein may be practiced using an alternative order of the steps illustrated in FIGS. 19A-K. That is, the flow of installation of the tub spout assembly 1600 illustrated in FIGS. 19A-K are provided as examples only, and the embodiments may be practiced using process flows that differ from those illustrated. Additionally, it is noted that not all steps are required in every embodiment. In other words, one or more of the steps may be omitted or replaced, without departing from the scope of the embodiments. Further, steps may be performed in different orders, in parallel with one another, or omitted entirely, and/or certain additional steps may be performed without departing from the scope and spirit of the embodiments.

Figure 19A:
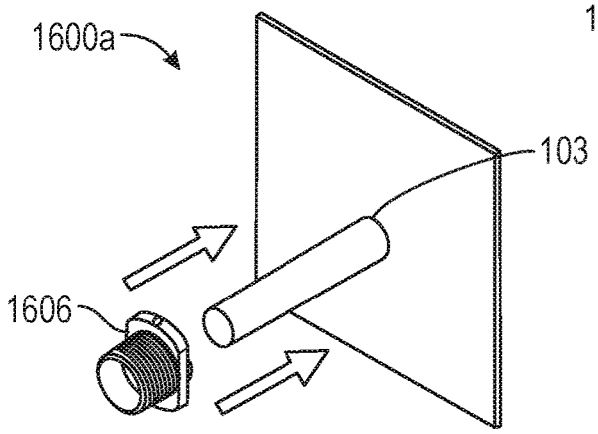
FIGS. 19A-K illustrate an example flowchart of an example installation of a tub spout according to various embodiments of the present disclosure.

With reference to FIG. 19A, shown is a tub spout assembly 1600*a* according to various embodiments of the present disclosure. An extension nipple adaptor 1606 can be inserted over the pipe 103. The extension nipple adaptor 1606 can be slid onto the pipe 103.

Figure 19B:
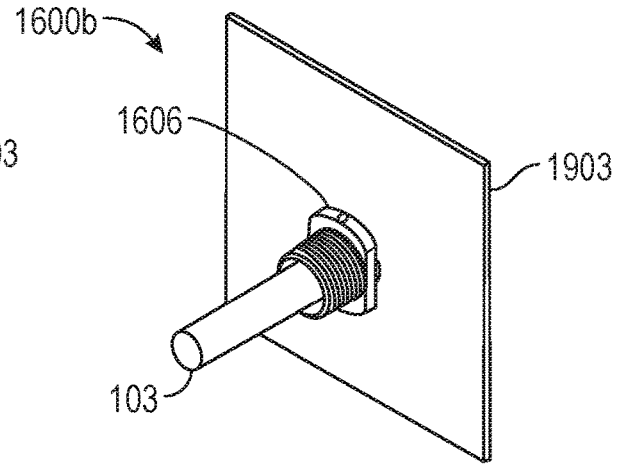

With reference to FIG. 19B, shown is a tub spout assembly 1600*b* according to various embodiments of the present disclosure. The extension nipple adaptor 1606 can be positioned against a wall 1903.

Figure 19C:
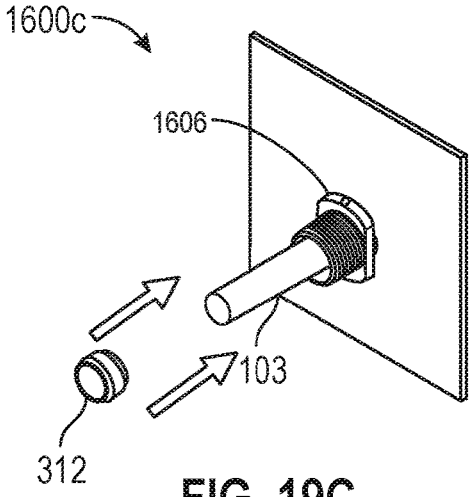

With reference to FIG. 19C, shown is a tub spout assembly 1600*c* according to various embodiments of the present disclosure. The compression ring 312 can be slid onto the pipe 103. The compression ring 312 can fit snugly on the pipe 103.

Figure 19D:
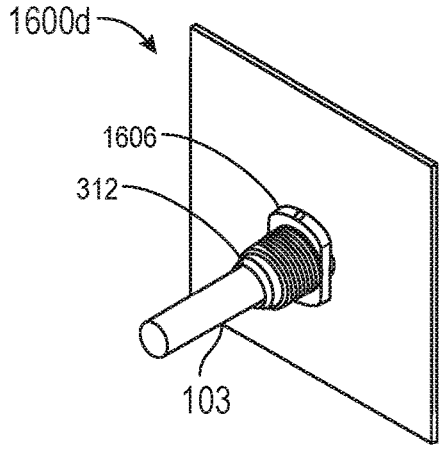

With reference to FIG. 19D, shown is a tub spout assembly 1600*d* according to various embodiments of the present disclosure. The compression ring 312 can be positioned abutting the extension nipple adaptor 1606.

Figure 19E:
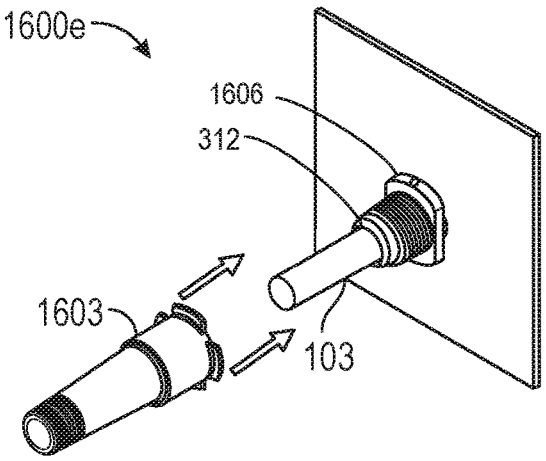

With reference to FIG. 19E, shown is a tub spout assembly 1600*e* according to various embodiments of the present disclosure. The extension nipple 1603 can be slide onto the pipe 103. The extension nipple 1603 can be screwed onto the extension nipple adaptor 1606. In some embodiments, the extension nipple 1603 is hand tightened onto the extension nipple adaptor 1606. The compression ring 312 can be compressed between the extension nipple 1603 and the extension nipple adaptor 1606. A clamping force can be applied on the compression ring 312 by the angled surface 1721 and the angled surface 1821 when the extension nipple 1603 is tightened.

Figure 19F:
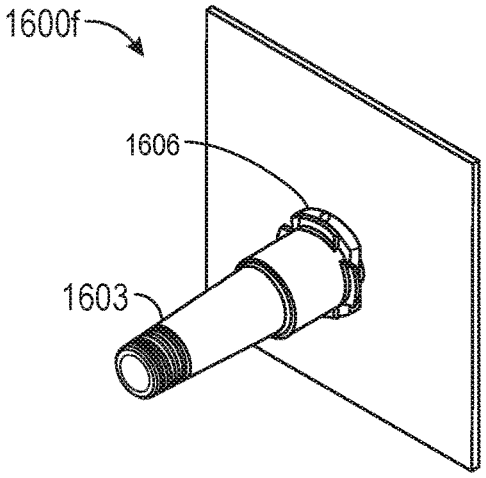

With reference to FIG. 19F, shown is a tub spout assembly 1600*f* according to various embodiments of the present disclosure. The flat surface 1724 (FIG. 17D) of the extension nipple 1603 can abut the flat surface 1824 (FIG. 18F) of the extension nipple adaptor 1606.

Figure 19G:
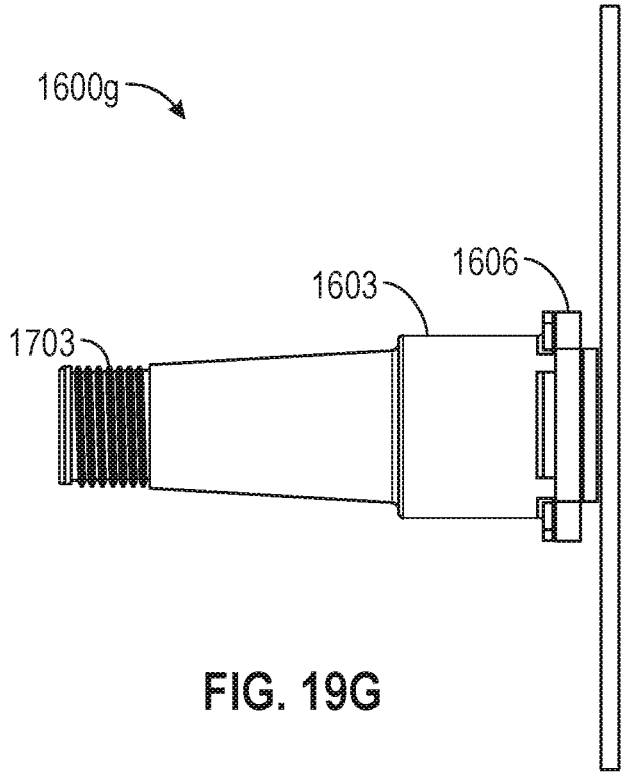

With reference to FIG. 19G, shown is a tub spout assembly 1600*g* according to various embodiments of the present disclosure. Thread tape or thread dope can be applied to the threads 1703.

Figure 19H:
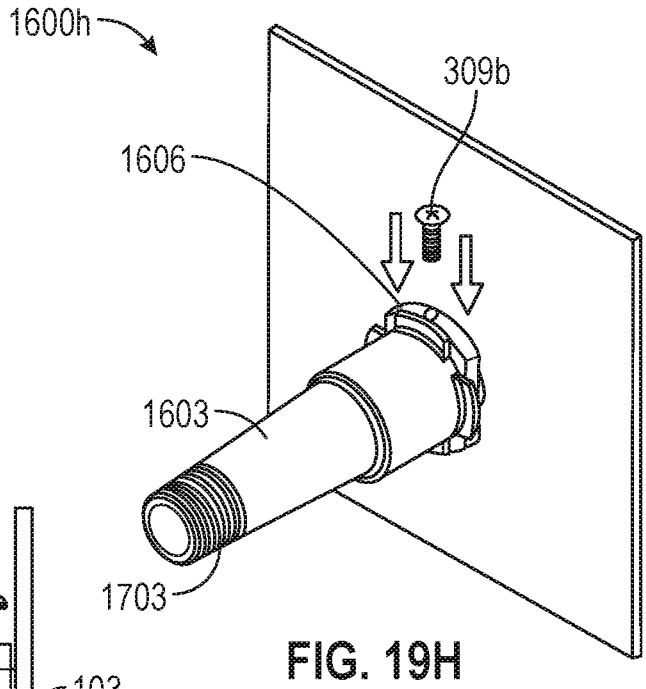

With reference to FIG. 19H, shown is a tub spout assembly 1600*h* according to various embodiments of the present disclosure. The screw 309*b* can be inserted into the aperture 1803. The screw 309*b* can turned until it contacts the pipe 103. The extension nipple adaptor 1606 can be held in place by the screw 309*b*.

Figure 19I:
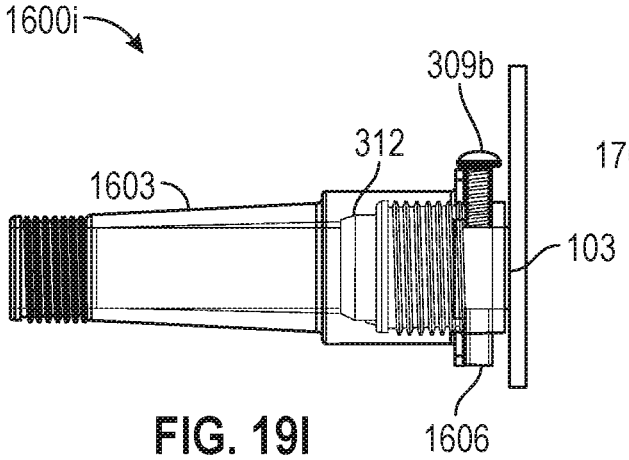

With reference to FIG. 19I, shown is a tub spout assembly 1600*i* according to various embodiments of the present disclosure.

Figure 19J:
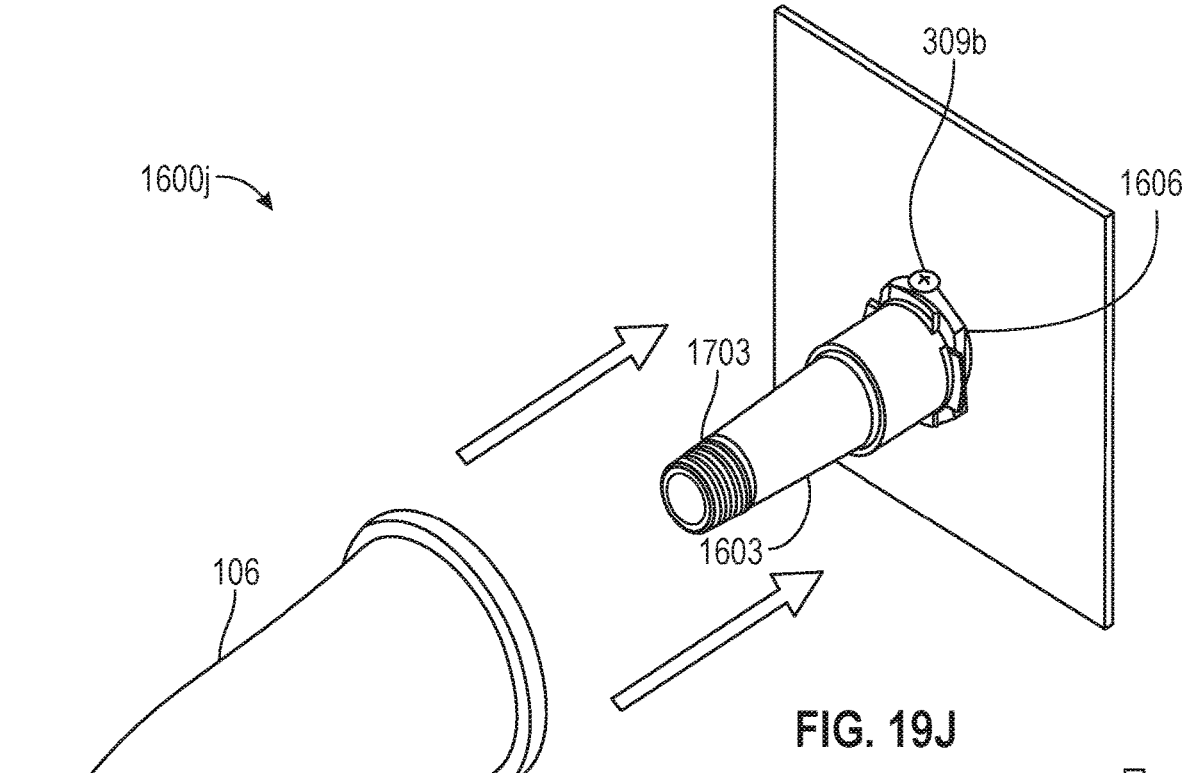

With reference to FIG. 19J, shown is a tub spout assembly 1600*j* according to various embodiments of the present disclosure. The tub spout 106 can be slid over the extension nipple 1603. The tub spout 106 can be screwed onto the extension nipple 1603. Thread tape or thread dope can be used to seal an interface between the threads of the tub spout 106 and threads 1703 of the extension nipple 1603.

Figure 19K:
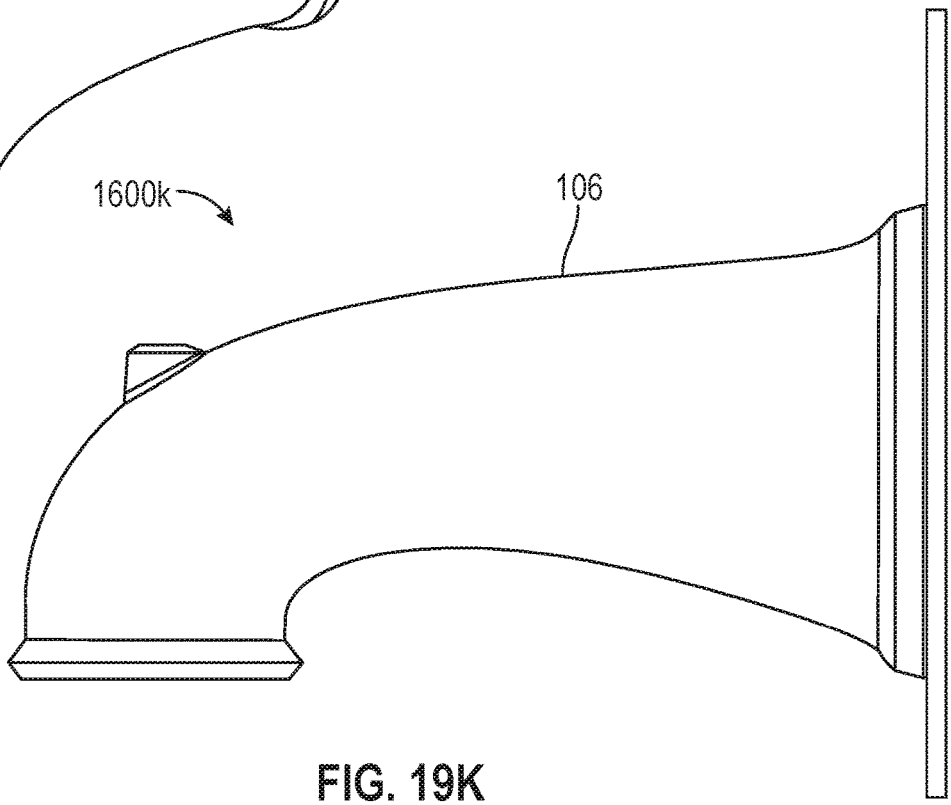

With reference to FIG. 19K, shown is a tub spout assembly 1600*k* according to various embodiments of the present disclosure. When tightened, the tub spout 106 can abut the wall. The tub spout 106 can be turned to align the spout downward when screwed onto the extension nipple 1603.

Although embodiments have been described herein in detail, the descriptions are by way of example. The features of the embodiments described herein are representative, and in alternative embodiments, certain features and elements may be added or omitted. Additionally, modifications to aspects of the embodiments described herein may be made by those skilled in the art without departing from the spirit and scope of the present disclosure defined in the following claims, the scope of which are to be accorded the broadest interpretation so as to encompass modifications and equivalent structures.

Therefore, at least the following is claimed:

1. A system comprising:

an extension nipple adaptor that has a first end and a second end, the first end comprising an outer thread and the second end comprising an adaptor head, the extension nipple adaptor having a pipe aperture that has an angled surface at the first end, wherein the adaptor head has a length that is larger than a diameter of the first end of the extension nipple adaptor, wherein the extension nipple adaptor is configured to slide over a pipe;

an extension nipple configured to be coupled to the extension nipple adaptor and a tub spout;

a compression ring; and a threaded screw.

2. The system of claim 1, wherein the extension nipple adaptor comprises ¾ inch 14 National Pipe Threads (NPT) threads.

3. The system of claim 1, wherein the extension nipple comprises ¾ inch 14 NPT threads on a first end and ½ inch NPT threads on a second end.

4. The system of claim 1, wherein the pipe is a ½ inch copper pipe.

5. The system of claim 1, wherein the compression ring is configured to be compressed against a pipe between the extension nipple adaptor and the extension nipple.

6. The system of claim 1, wherein the threaded screw is configured to screw into the extension nipple adaptor and to contact a pipe.

7. The system of claim 1, wherein the extension nipple is configured to be threaded onto the extension nipple adaptor.

8. The system of claim 1, wherein the extension nipple is configured to be affixed to the tub spout via a threaded connection.

9. The system of claim 1, wherein the compression ring is situated between the extension nipple and the extension nipple adaptor.

10. The system of claim 1, wherein the extension nipple adaptor comprises a slot on the second end.

11. The system of claim 1, wherein the angled surface of the extension nipple adaptor is a first angled surface, and the compression ring comprises a second angled surface.

12. The system of claim 1, wherein the adaptor head comprising a fastener aperture that includes a knock-out.

13. A system, comprising:

an extension nipple adaptor that has a first end and a second end, the first end has a threaded rod, the extension nipple adaptor having a pipe aperture that has a first angled surface at the first end, the pipe aperture extending from the first end to the second end, the extension nipple adaptor includes an adaptor head with a side length that is larger than a diameter of the pipe aperture at the first end of the extension nipple adaptor;

an extension nipple configured to be coupled to the extension nipple adaptor and a tub spout, the extension nipple has a third end and a fourth end, the third end having an interior threaded surface that is configured to be attached to the threaded rod of the extension nipple adaptor, wherein the third end of the extension nipple has a larger diameter than the fourth end; and a compression ring that comprises a second angled surface, the second angled surface being configured to come in contact with the first angled surface of the pipe aperture for the extension nipple adaptor.

14. The system of claim 13, wherein the adapter head having a side width than is less than the side length of the adapter head.

15. The system of claim 1, wherein the diameter of the pipe aperture at the first end is larger than a respective diameter of an opening in the adapter head at the second end.

16. The system of claim 13, wherein the fourth end of the extension nipple has outer threaded surface that is configured to attach to a threaded portion of the tub spout.

* * * * *